US005914468A

United States Patent [19]

Nishimura et al.

[11] Patent Number: 5,914,468

[45] Date of Patent: Jun. 22, 1999

[54] KEYBOARD UNIT AND KEY SWITCH

[75] Inventors: Takashi Nishimura; Toshimi Chiba; Sadao Tachibana; Zenzo Tozuka, all of Tokyo; Yuichiro Nozawa, Takasaki, all of Japan

[73] Assignee: Oki Electric Industry Co. Ltd., Tokyo, Japan

[21] Appl. No.: 08/912,869

[22] Filed: Aug. 19, 1997

[30] Foreign Application Priority Data

| | | | |
|---|---|---|---|
| Aug. 23, 1996 | [JP] | Japan | 8-222476 |
| Dec. 24, 1996 | [JP] | Japan | 8-343182 |
| Dec. 25, 1996 | [JP] | Japan | 8-345308 |
| Dec. 25, 1996 | [JP] | Japan | 8-345309 |
| Dec. 25, 1996 | [JP] | Japan | 8-345310 |
| Apr. 4, 1997 | [JP] | Japan | 9-086256 |

[51] Int. Cl.[6] ..... H01H 13/70

[52] U.S. Cl. ..... 200/5 A; 200/517; 200/344

[58] Field of Search ..... 200/5 A, 512, 200/517, 341, 343–345; 400/472, 488–491.2, 492, 495, 495.1, 496

[56] References Cited

FOREIGN PATENT DOCUMENTS 5-290673 11/1993 Japan ..... H01H 13/20

*Primary Examiner*—Michael A. Friedhofer
*Attorney, Agent, or Firm*—Rabin & Champagne P.C.

[57] ABSTRACT

A keyboard unit having a base plate, and a plurality of key switches provided on the base plate. Each of the key switches has an electric contact provided within a membrane sheet on the base plate, an elastic dome portion formed on the base plate so as to cover the electric contact, a bearing portion provided on base plate, and a key cap having a support shaft which engages the bearing portion, and an engaging portion which engages the dome portion. When the key cap is depressed, the dome portion is elastically deformed so that an inner surface of the dome portion presses against the electric contact, and when the key cap is not depressed, deformation of the dome portion is removed so that the inner surface of the dome portion is separated from the electric contact and the key cap is pushed up by the dome portion.

39 Claims, 20 Drawing Sheets

KEYBOARD UNIT AND KEY SWITCH

BACKGROUND OF THE INVENTION

The present invention relates to a keyboard unit that is employed as an input unit for an information processor and a key switch incorporated into this keyboard unit. More particularly, the present invention relates to a keyboard unit and a key switch suitable for thin portable personal computers.

FIG. 1 is an exploded perspective view schematically showing a conventional key switch. FIGS. 2A and 2B are vertical sectional views showing the key switch of FIG. 1. FIG. 2A shows when the key switch is not depressed and FIG. 2B shows when the key switch is depressed by an operator.

As shown in the figures, the key switch 1 is provided on a base plate 2 made of metal or plastic or the like. The key switch 1 has a membrane sheet 3 with an electric contact 3*a*, and a click rubber 4 consisting of an elastic insulator which is provided on the membrane sheet 3.

The click rubber 4 has an elastic dome portion 5 covering the electric contact 3*a* within the membrane sheet 3, and a sheet portion 6 provided on the membrane sheet 3.

Also, the key switch 1 has a key cap 7 which is in contact with a top portion of the dome portion 5, and a key cap cover 8.

The key cap 7 has a ceiling plate 7*a*, a support shaft 7*b* and a brim portion 7*c*. The key cap cover 8 has bearing portions 8*a* which support the support shaft 7*b* of the key cap 7 in such a way that the key cap 7 can be swung on the bearing portions 8*a*, and an edge portion 8*b* which comes in contact with the brim portion 7*c* of the key cap 7 when the key cap 7 is not depressed. The edge portion 8*b* of the key cap cover 8 has a function as a stopper for preventing the key cap 7 from slipping out upward.

In the key switch 1 with the above-described structure, as shown in FIG. 2B, when the key cap 7 is depressed by the operator, it will be rotated downward on the support shaft 7*b* and the dome portion 5 will be buckled and elastically deformed. The deformation of the dome portion 5 causes the protrusion 5*a* of the inner surface of the dome portion 5 to press against the electric contact 3*a* within the membrane sheet 3.

In the key switch 1, incidentally, in order to prevent the finger of the operator from striking on the key cap cover 8 and reducing the operability when the key cap 7 is depressed, it is necessary in the free state shown in FIG. 2A (i.e., when the keycap is not depressed) that the length $H_1$ from the upper surface of the key cap cover 8 to the uppermost portion of the key cap 7 be made longer than the key stroke $H_S$ between the protrusion 5*a* and the electric contact 3*a*. It is also necessary that the length $H_2$ from the lower surface of the base plate 2 to the upper surface of the key cap cover 8 be made longer than the length Hc from the lower surface of the base plate 2 to the top portion of the dome portion 5.

In the key switch 1, however, supposing the key stroke $H_S$ is lengthened, the position of the upper surface of the edge portion 8*b* of the key cap cover 8 which is utilized as a stopper is higher (that is, the length $H_2$ will be higher). For this reason, the length $H_1$ has to be made longer and the dimension $H_0$ ($=H_1+H_2$) from the lower surface of the base plate 2 to the uppermost portion of the key cap 7 becomes longer, so that there arises the problem that the keyboard unit becomes thick. Also, conversely, in order to achieve thinning of the keyboard unit, the keystroke $H_S$ must be sacrificed. In other words, lengthening of the stroke of the key switch 1 and thinning of the keyboard unit are incompatible to each other.

SUMMARY OF THE INVENTION

Accordingly, it is an object of the present invention to provide a key switch that is long in stroke and thin in thickness and a keyboard unit incorporating this key switch.

According to one aspect of the present invention, a keyboard unit has: a base plate; an electric contact provided on the base plate; an elastic dome portion formed on the base plate so as to cover the electric contact; a bearing portion provided on the base plate; and a key cap having a shaft which engages with the bearing portion, and an engaging portion which engages with the dome portion. When the key cap is depressed, the dome portion is elastically deformed so that an inner surface of the dome portion presses against the electric contact, and when the key cap is not depressed, deformation of the dome portion is removed so that the inner surface of the dome portion is separated from the electric contact and the key cap is pushed up by the dome portion.

According to another aspect of the present invention, a keyboard unit has: a base plate; and a plurality of key switches arranged in a plurality of rows from an operator-side near an operator toward a depth-side which is an opposite side of the operator-side. Each of the plurality of key switches has an electric contact provided on the base plate; an elastic dome portion formed on the base plate so as to cover the electric contact; a bearing portion provided on the base plate; and a key cap having a shaft which engages with the bearing portion, and an engaging portion which engages with the dome portion. When the key cap is depressed, the dome portion is elastically deformed so that an inner surface of the dome portion presses against the electric contact, and when the key cap is not depressed, deformation of the dome portion is removed so that the inner surface of the dome portion is separated from the electric contact and the key cap is pushed up by the dome portion. The plurality of key switches includes an operator-side fall type key switch, the bearing portion of which is disposed on the operator-side with respect to the key cap of the operator-side fall type key switch, andadepth-side fall type key switch, the bearing portion of which is disposed on the depth-side with respect to the key cap of the depth-side fall type key switch.

According to still another aspect of the present invention, a keyboard unit has: a base plate; an electric contact provided on the base plate; an elastic dome portion formed on the base plate so as to cover the electric contact; an actuator having a supported portion which is supported on the base plate so that the actuator is able to be swung on the supported portion, and a first engaging portion which is opposite to the supported portion; and a key cap having a second engaging portion which engages with the first engaging portion of the actuator so that the key cap is rotatable on the second engaging portion of the actuator. When the key cap is not depressed, the key cap is pushed up by the dome portion so that the inner surface of the dome portion is separated from the electric contact; when a side of a free end of the key cap opposite to the second engaging portion is depressed, the dome portion is elastically deformed so that an inner surface of the dome portion presses against the electric contact; and when a side of the second engaging portion of the key cap is depressed, the first engaging portion of the actuator is moved down and then the dome portion is elastically deformed so that an inner surface of the dome portion presses against the electric contact.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

First Embodiment

Figure 3:
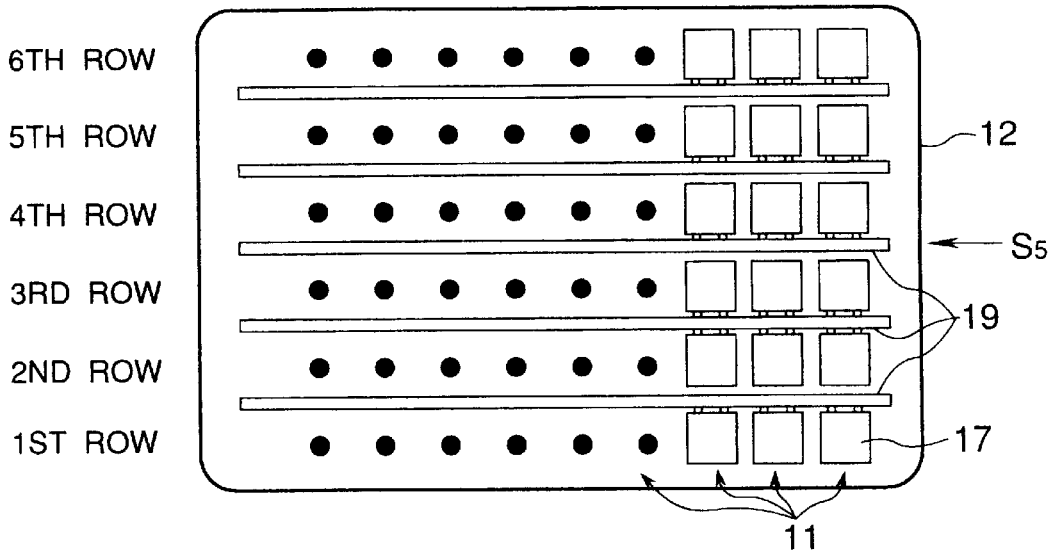
FIG. 3 is a plan view schematically showing a keyboard unit incorporating key switches arranged in rows and columns according to a first embodiment of the present invention.
Figure 4:
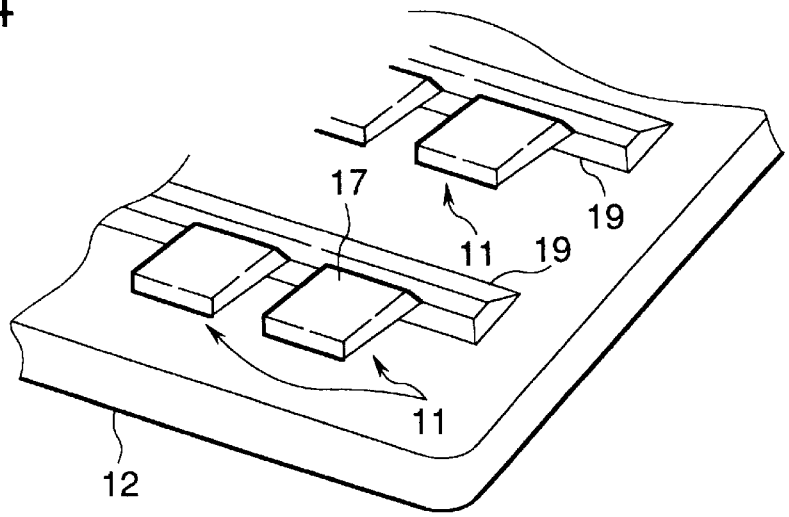
FIG. 4 is a perspective view schematically showing on an enlarged scale a part of the keyboard unit of FIG. 3.
Figure 5:
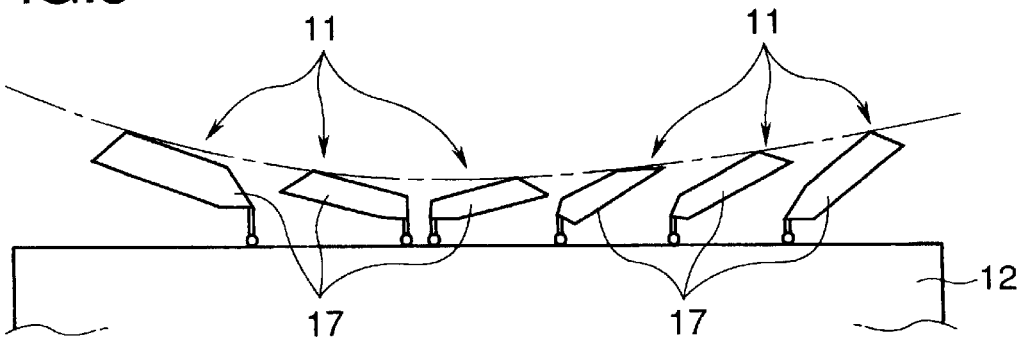
FIG. 5 is a schematic side view of the keyboard unit of FIG. 3 taken in a direction of an arrow $S_5$.

FIG. 3 is a plan view schematically showing a keyboard unit incorporating key switches arranged in rows and columns according to a first embodiment of the present invention. FIG. 4 is a perspective view schematically showing on an enlarged scale a part of the keyboard unit of FIG. 3. FIG. 5 is a schematic side view showing the keyboard unit taken in a direction of an arrow $S_5$ in FIG. 3.

As shown in FIG. 3, the keyboard unit of the first embodiment has a base plate 12 made of metal or plastic or the like, and a plurality of key switches 11 arranged in rows and in columns on the base plate 12. Further, each mark of "●" in FIG. 3 indicates the key switch 11.

Figure 6:
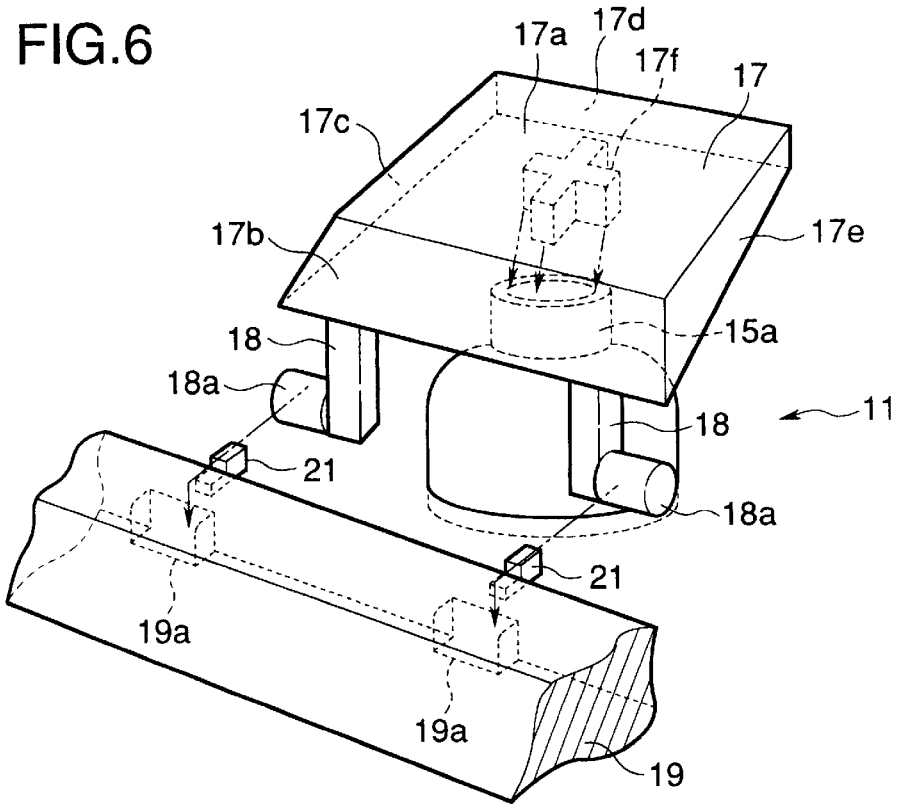
FIG. 6 is an exploded perspective view schematically showing one of the key switches of FIG. 3.
Figure 7:
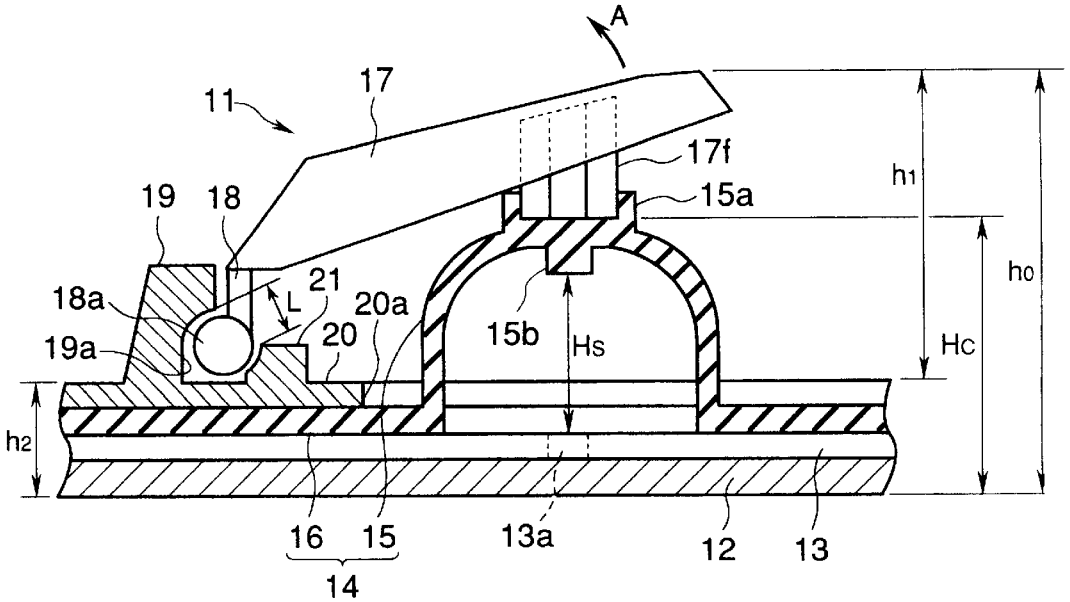
FIG. 7 is a vertical sectional view schematically showing the key switch shown in FIG. 6.

FIG. 6 is an exploded perspective view showing one of the key switch 11 shown in FIG. 3. FIG. 7 is a vertical sectional view showing the key switch of FIG. 6.

As shown in FIG. 6 and FIG. 7, the key switch 11 according to the first embodiment is provided on a base plate 12. The key switch 11 has a membrane sheet 13 with an electric contact 13*a* and a click rubber 14 consisting of an elastic insulator which is provided on the membrane sheet 13.

The click rubber 14 has a dome portion 15 covering the electric contact 13*a* within the membrane sheet 13, and a sheet portion 16 overlaid on the membrane sheet 13.

Further, the key switch 11 according to the first embodiment has a key cap 17 equipped with support portions 18 each having a support shaft 18*a* at its lower end, and a bearing portion 19 which supports the support shafts 18*a* of the key cap 17 so that the key cap 17 is rotatable on the support shafts 18*a*.

The key cap 17 has a ceiling plate 17*a* which is depressed with a finger of an operator, a side plate 17*b* inclined with respect to the ceiling plate 17*a*, and side plates 17*c*, 17*d* and 17*e* substantially vertical to the ceiling plate 17*a*. The inclined side plate 17*b* is fixed to the support portions 18. Alternatively, the inclined side plate 17*b* is formed integrally with the support portions 18.

The bearing portion 19, as shown in FIG. 3, FIG. 4 and FIG. 7, is formed integrally with a cover sheet 20 provided on the sheet portion 16 of the click rubber 14. Further, as shown in FIG. 3 and FIG. 5, the bearing portions 19 are formed in 6 rows in correspondence with 6 rows of key switches 11, respectively.

As shown in FIG. 6 and FIG. 7, the side surface of the bearing portion 19 is formed with bearing grooves 19*a* into which the support shafts 18*a* parallel to the base plate 13 are inserted. On the cover sheet 20, protruding stoppers 21 are provided at positions opposite to the corresponding bearing grooves 19*a*. The stoppers 21 have a function of preventing the support shafts 18*a* and accordingly the key cap 17 from slipping out of the bearing groove 19*a* in an upward direction indicated by an arrow A. The stoppers 21 enable the support shafts 18*a* to be fitted into the bearing grooves 19*a* so as to be freely rotatable and so as not to be disengaged from the bearing groove 19*a*.

In the first embodiment, while the bearing portions 19 have been formed integrally with the cover sheet 20, the bearing portions 19 may also be formed from a separate member and bonded to the cover sheet 20. Further, the stoppers 21 are not limited to the above-described configuration.

Instead of the two support portions 18 of each key cap 17, a single support portion may be attached to the central bottom portion of the side plate 17*b*, and the single support portion may be provided with a single support shaft extending in a direction parallel to the side plate 17*b*.

The support shafts 18*a* can also be provided on the outside of the side plates 17*c* and 17*e*, respectively.

The cover sheet 20 is mounted on the sheet portion 16 and has a circular opening 20*a* through which the dome portion 15 is inserted. At the opening 20*a* of the cover sheet 20, the dome portion 15 is disposed so as to cover the electric contact 13*a*.

The top portion of the dome portion 15 is provided with a cylindrical top tube 15*a*, and on the back side of the top portion of the dome portion 15, a protrusion 15*b* for pressing against the electric contact 13*a* is provided.

On the back side of the ceiling plate 17*a* of the key cap 17, a cap rib 17*f* with a cruciform section is protruded. The cap rib 17*f* is fitted into the top tube 15*a* of the dome portion 15 so that the key cap 17 is not lifted up and is positioned with respect to the dome portion 15. Further, the sectional configuration of the cap rib 17*f* is not limited to a cross. Also, the configuration of the top tube 15*a* is not limited to a cylindrical shape.

The key switch 11 shown in FIG. 6 and FIG. 7 is assembled, for example, as follows.

The cover sheet 20 is made, for example, of plastic material and has been formed integrally with the bearing portions 19 and the stoppers 21. Also, the key cap 17 is made, for example, of plastic material and has been formed, for example, integrally with the support portions 18 equipped with the support shafts 18*a* and the cap rib 17*f*.

First, the membrane sheet 13 is mounted on the base plate 12, the click rubber 14 is mounted thereon, and the cover sheet 20 is mounted thereon. Then, the support shafts 18*a* of the key cap 17 are inserted into the bearing space formed between the bearing grooves 19*a* and the stoppers 21, and also the cap rib 17*f* is fitted into the top tube 15*a* of the dome portion 15.

The dimension L of the bearing space shown in FIG. 7 has been made slightly smaller than the outer diameter of the support shaft 18*a*. Therefore, the support shafts 18*a* are pressed into the bearing space. At this time, the outer peripheral surfaces of the support shafts 18*a* strike on the bearing portions 19 and the stoppers 21 and then the support shafts 18*a* are inserted into the bearing space, while expanding the dimension L. After inserting the support shafts 18*a* into the bearing grooves 19*a*, the elastic deformation of the bearing portions 19 and the stoppers 21 is released. Thereafter, the support shafts 18*a* are held within the bearing grooves 19*a* so that they are rotatable without slipping out of the bearing grooves 19*a*.

In the key switch 11 with the above-described structures shown in FIG. 7, when the key cap 17 is depressed, it is rotated downward on its support shafts 18*a* and the dome portion 15 is buckled and deformed. The deformation of the dome portion 15 causes the protrusion 15*b* of the inner surface of the dome portion 15 to press against the electric contact 13*a* within the membrane sheet 13. Consequently, the electric contact 13*a* is electrically connected.

Figure 1:
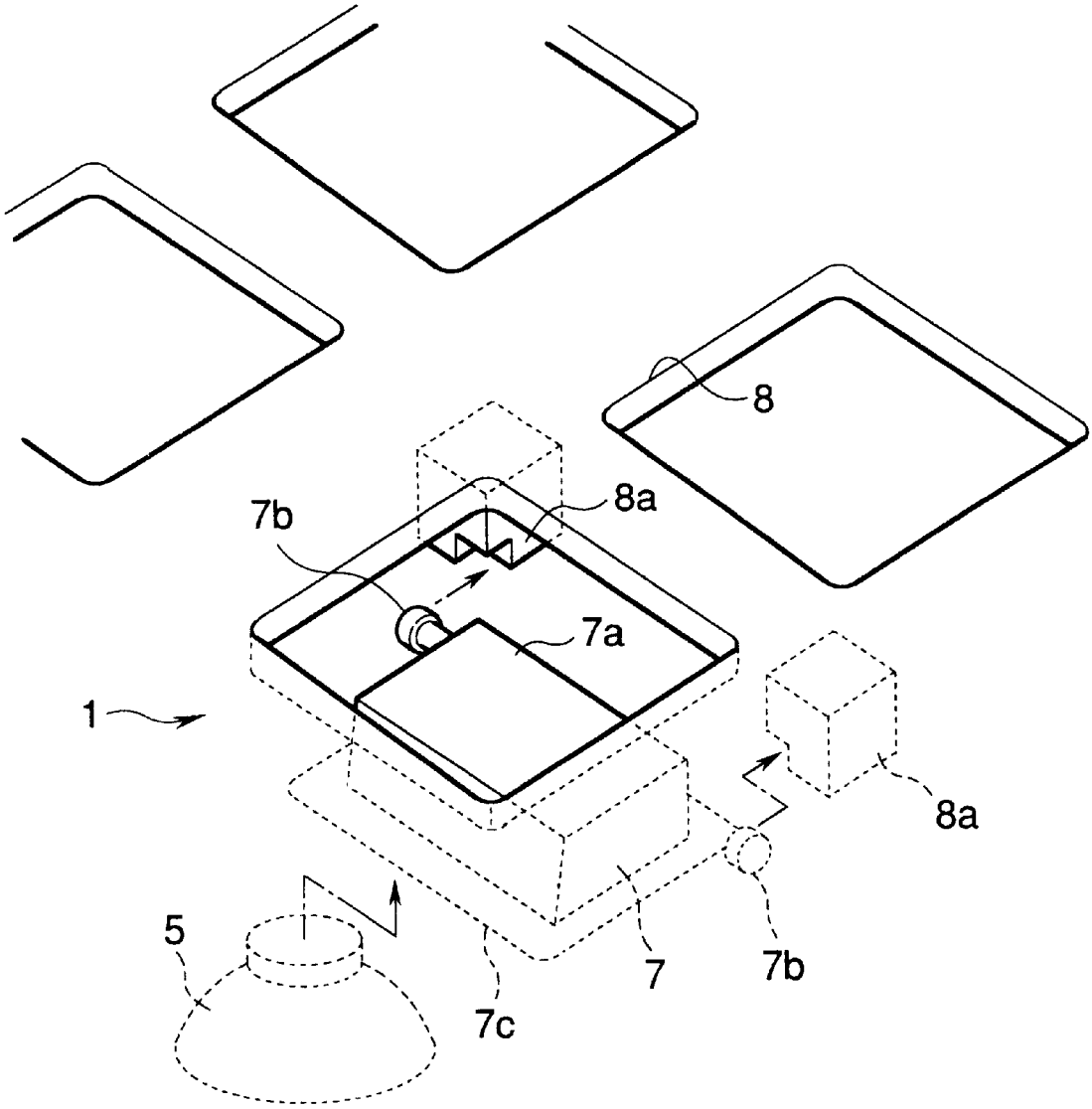
FIG.1 PRIOR ART
FIG. 1 is an exploded perspective view schematically showing an example of the conventional key switch.
Figure 2A:
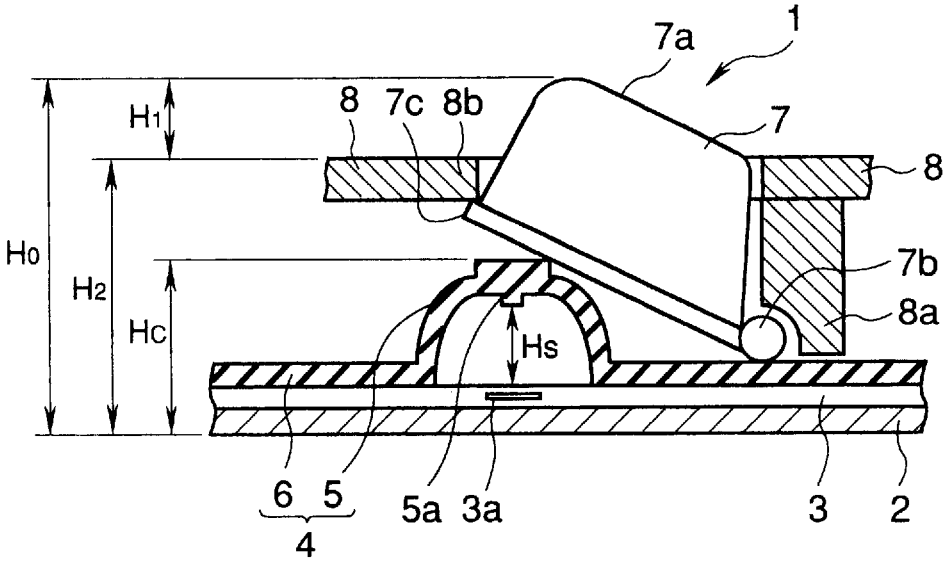
FIG.2A PRIOR ART
FIGS. 2A and 2B are vertical sectional views showing the key switch of FIG. 1.
Figure 2B:
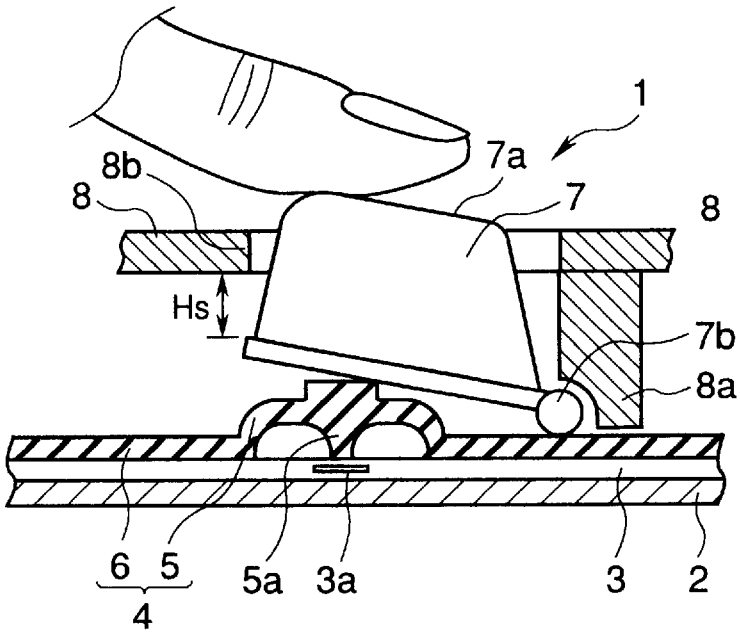
FIG.2B PRIOR ART

At this time, the height (or thickness) $h_2$ from the lower surface of the base plate 12 to the upper surface of the cover sheet 20 does not have to be made longer than the height $H_c$ from the lower surface of the base plate 12 to the top portion of the dome portion 15, unlike the conventional key switch shown in FIG. 2A. Therefore, the thickness $h_2$ of the keyboard base (consisting of the members 12, 13, 16 and 20) of the key switch can be made smaller than that ($H_2$ of FIG. 2A) of the conventional key switch.

Also, if the dimension $h_1$ from the upper surface of the cover sheet 20 to the uppermost portion of the key cap 17 is greater than the stroke $H_S$, there is no possibility that the finger of an operator strikes on the cover sheet 20, thereby reducing the operability. Therefore, if the dimension $h_1$ is made equal to the conventional dimension (dimension $H_1$ in FIG. 2A), then the dimension $h_0$ ($=h_1+h_2$, referred to as key cap height) from the lower surface of the base plate 12 to the uppermost portion of the key cap 17 can be made smaller than the conventional dimension ($H_0$ in FIG. 2A). In addition, if the dimension $h_0$ is made equal to the conventional dimension $H_0$, the stroke $H_S$ of the first embodiment can be greater than the conventional stroke shown in FIG. 2A.

Next, a description will be made of the keyboard unit of FIG. 3 where the key switches 11 with the structures shown in FIG. 6 and FIG. 7 are arranged in 6 rows.

As shown in FIG. 3, the key switches 11 of the first and second rows on a side near the operator (i.e., the operator-side) which is a lower side in FIG. 3 have the bearing portions 19 on a side far from the operator (i.e., the depth-side) which is an upper side in FIG. 3, respectively. Therefore, when the key cap 17 is depressed, the key cap 17 is rotated on the support shafts 18*a* provided on the depth-side and the operator-side of the key cap 17 falls. This type will hereinafter be referred to as an operator-side fall type.

Further, the key switches 11 of the third through sixth rows from the operator-side have the bearing portions 19 on the operator-side of the respective key caps 17. Therefore, when the key switch 11 is depressed, the key cap 17 is rotated on the support shafts 18*a* provided on the operator-side and the depth-side of the key cap 17 falls. This type will hereinafter be referred to as a depth-side fall type.

Furthermore, as shown in FIG. 5, the heights (which correspond to ho in FIG. 7) of the key caps 17 are varied for each row of key switches 17, and a curve (one-dotted chain line in FIG. 5) linking the uppermost portions of the key caps 17 is formed into a sculpture slope shape.

As has been described above, in the first embodiment, by the bearing grooves 19*a* of the bearing portion 19 and the stoppers 21, the support shafts 18*a* of the key cap 17 can be mounted so that the key cap 17 is rotatable on the support shafts 18*a* without slipping out. Therefore, there can be realized the key switch 11 which is thin in thickness and long in stroke. Also, due to the keyboard unit with a plurality of key switches 11 according to the first embodiment, there can be realized the keyboard unit which is long in stroke and thin in thickness.

Further, in the keyboard unit where the operator-side fall type key switches are adopted in the 2 rows on the operator-side and the depth-side fall type key switches are adopted in the 4 rows on the depth-side, a curve linking the uppermost portions of the key caps 17 is formed into a sculpture slope shape, as shown in FIG. 5. In this way, it becomes possible to adopt human engineering elements which have so far been sacrificed for low-height priority, and consequently, the keyboard unit which is low in height and easy to use can be realized.

In the above-described first embodiment, while a description has been made of the case where the stoppers 21 are provided, the mechanism for supporting the support shafts 18*a* of the key cap 17 by the bearing portions 19 is not limited to this.

Also, in the above-described first embodiment, although the bearing portions 19 have been provided so as to be common to all key caps 17 of the key switches of the same row, the bearing portions 19 may be provided for each key switch 11 of the same row.

In addition, FIG. 3 merely shows an example of the keyboard unit, so the number of rows of the key switches of the keyboard unit is not limited to 6 rows.

Furthermore, arrangement of the operator-side fall type key switches and the depth-side fall type key switches is not limited to the array of FIG. 3. For example, the key switches of the first through third rows maybe operator-side fall type, or both the operator-side fall type key switches and the depth-side fall type key switches may be mixed in the same row of the key switches.

Second Embodiment

Figure 8:
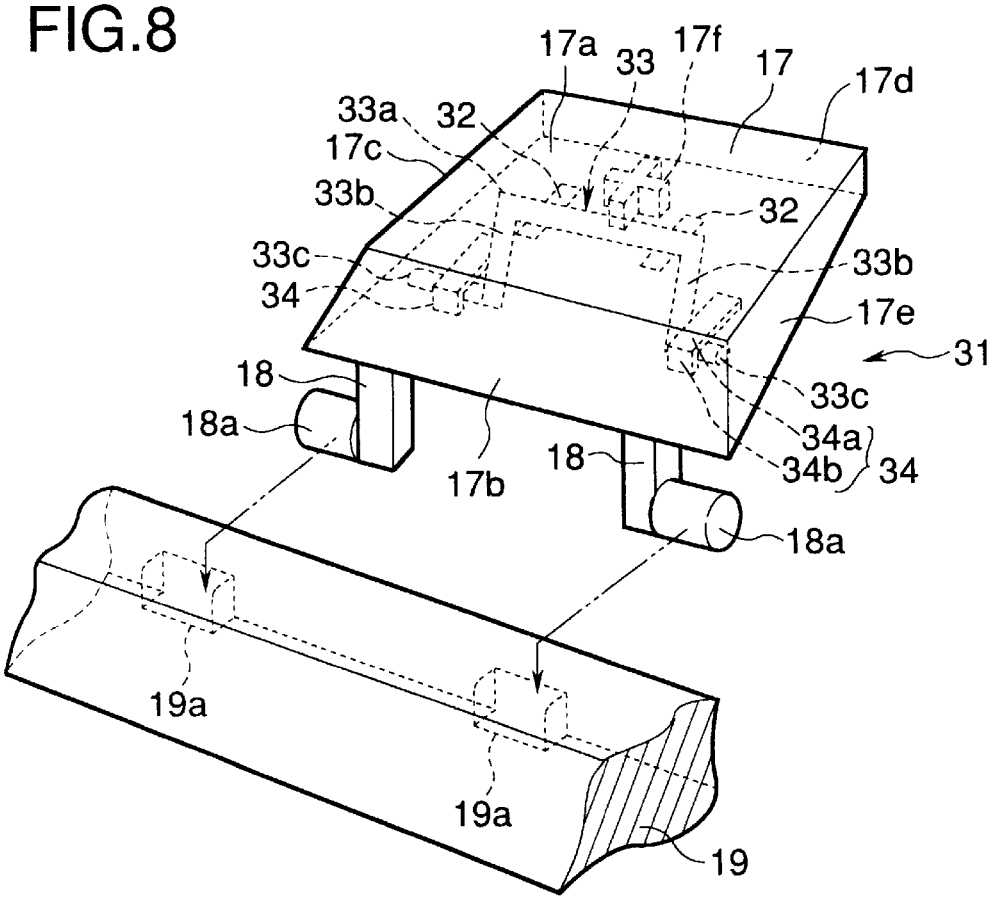
FIG. 8 is an exploded perspective view schematically showing a key switch according to a second embodiment of the present invention.
Figure 9:
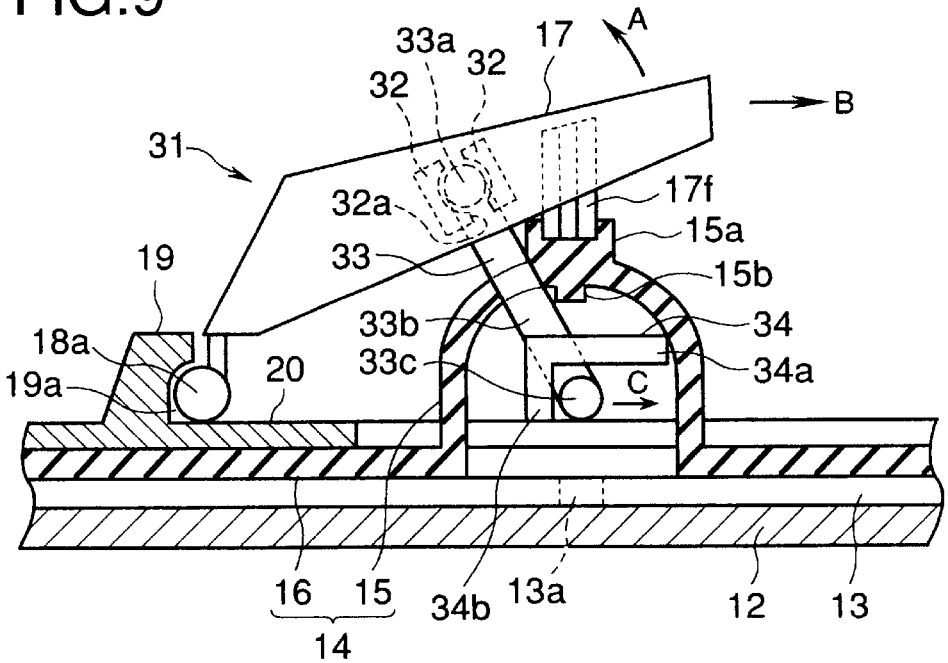
FIG. 9 is a vertical sectional view schematically showing the key switch shown in FIG. 8.

FIG. 8 is an exploded perspective view schematically showing a key switch of a second embodiment of the present invention. FIG. 9 is a vertical sectional view schematically showing the key switch of FIG. 8. Those structures in FIG. 8 and FIG. 9 that are identical to or correspond to structures in FIG. 3 through FIG. 7 are assigned identical symbols.

A key switch 31 of the second embodiment differs from the key switch 11 of the first embodiment in that the stoppers 21 of the first embodiment are omitted, bearing portions 32, a connecting rod 33 and slide guides 34 are equipped under the key cap 17, and the slide portions 33*c* of the connecting rod 33 slide along the upper surface of the cover sheet 20 in a direction C in FIG. 9 or its reverse direction.

As shown in FIG. 8 and FIG. 9, the bearing portions 32 are provided on the back side of the ceiling plate 17*a* of the key cap 17, and the support shaft 33*a* of the connecting rod 33 is rotatably supported by the bearing portions 32. The arm portions 33*b* extends downward from both ends of the support shaft 33*a*, and the slide portions 33*c* projects from the lower ends of the arm portions 33*c* to the outside.

Also, the slide guides 34 are provided on the base plate 20. The slide guides 34 are L-shaped plate members, each of which consists of a horizontal guide portion 34*a* and a support portion 34*b* extending in a vertical downward direction from the end of the horizontal guide portion 34*a* on the side of the bearing portion 19. The lower end of the support portion 34*b* of the slide guide 34 is connected to or formed integrally with the base plate 12. The slide portion 33*c* is engaged by the slide guide 34 and slides on the cover sheet 20 within the space formed between the slide guide 34 and the cover sheet 20. The connection of the key cap 17 and the base plate 12 due to the connecting rod 33 prevents the key cap 17 from slipping out in the upward direction (indicated by an arrow A) of FIG. 9 and at the same time prevents the cap rib 17*f* from slipping out of the top tube 15*a*.

Further, the slipping-out of the support shaft 18*a* from the bearing groove 19*a* by movement of the key cap 17 in a direction of an arrow B is prevented by engagement between the cap rib 17*f* and the top tube 15*a*.

The cover sheet 20 is made, for example, of plastic material or the like. The cover sheet 20 has been formed integrally with the bearing portion 19 having the bearing grooves 19*a*. The cover sheet 20 has an opening 20*a* into which the slide guide 34 and the dome portion 15 are inserted. Also, the connecting rod 17 is made, for example, of metal material or the like.

When assembling the key switch 31, the membrane sheet 13 is first mounted on the base plate 12, the click rubber 14 with the dome portion 15 is mounted on the membrane sheet 13, and the cover sheet 20 is mounted on the click rubber 14. Then, the support shafts 18*a* of the key cap 17 are inserted into the bearing grooves 19*a*. Finally, the support shaft 33*a* of the connecting rod 33 is inserted into the bearing portions 32 of the key cap 17, and also the cap rib 17*f* of the key cap 17 is fitted into the top tube 15*a* of the dome portion 15.

The openings 32*a* of the bearing portions 32 (shown in FIG. 9) have been made slightly smaller than the outer diameter of the support shaft 33*a*. Therefore, the outer peripheral surface of the support shaft 33*a* is pressed into the bearing portion 32. At this time, the support shaft 33*a* is inserted into the bearing portion 32, while expanding the opening 32*a* of the bearing portion 32.

When the key cap 17 in the second embodiment is depressed, the slide portions 33*c* slide within the slide guides 34 in the direction of an arrow C and the key cap 17 is rotated downward on the support shaft 18*a*. Then, the cap rib 17*f* pushes the top portion of the dome portion 15, and the dome portion 15 is buckled and elastically deformed. The buckling deformation of the dome portion 15 causes the protrusion 15*b* to press against the electric contact 13*a* within the membrane sheet 13. Consequently, the electric contact 13*a* is electrically connected.

According to the second embodiment, in the same way as the first embodiment, the dimension from the lower surface of the base plate 12 to the uppermost portion of the key cap 17 can be made shorter than that of the conventional key switch of FIG. 2A, or the stroke can be made longer than the conventional stroke.

In addition, according to the second embodiment, since the connecting rod 33 is provided, the support shafts 18*a* of the key cap 17 are rotatably inserted into the bearing grooves 19*a* without slipping out. In this way, the key switch 31 which is low in height but long in stroke can be realized. Furthermore, by arranging the key switches 31 in the keyboard unit, there can be realized the keyboard unit where the stroke of the key switch is long and which is thin in thickness.

Moreover, both the operator-side fall type key switches and the depth-side fall type key switches are arranged in the keyboard unit, and a curve linking the uppermost portions of these key switches 31 together can be formed into a sculpture slope shape. As a result, the keyboard unit which is low in height but easy to use can be realized.

Except for the above points, the second embodiment is the same as the above-described first embodiment.

Third Embodiment

Figure 10:
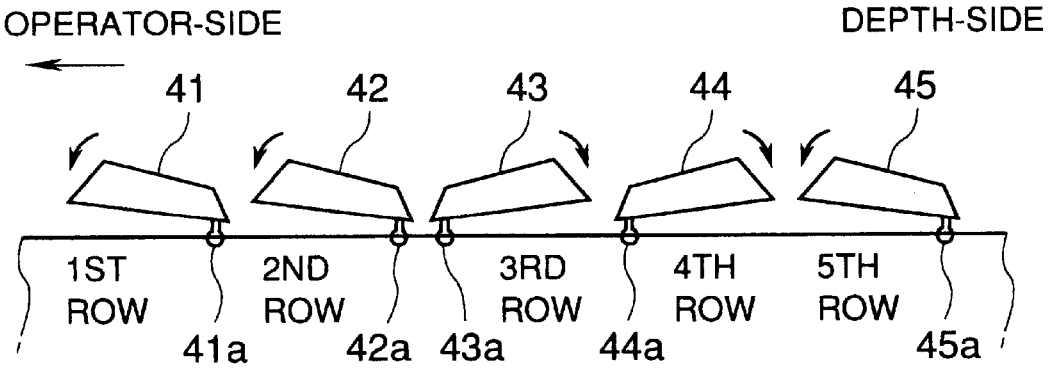
FIG. 10 is a schematic side view showing a keyboard unit according to a third embodiment of the present invention.

FIG. 10 is a schematic side view showing a keyboard unit according to a third embodiment of the present invention.

In the keyboard unit of the third embodiment, 5 rows of key switches are arranged from the operatorside (from the left side in FIG. 10) in accordance with a predetermined rule.

The key switches 41–45 used here have the same structure as that described in the first embodiment. However, the key switches 41–45 in the third embodiment may also have the same structure as that described in the second embodiment.

In the keyboard unit of the third embodiment, as shown in FIG. 10, the support shafts 41*a*, 42*a* and 45*a* of the key switches 41, 42 and 45 of the first, second and fifth rows are respectively provided on the depth-side of the key switches 41, 42 and 45. Also, the support shafts 43*a* and 44*a* of the key switches 43 and 44 of the third and fourth rows are respectively provided on the operator-side of the key switches 43 and 44.

Therefore, when an operator strikes one of the key switches 41, 42 and 45 of the first, second and fifth rows, the operator-side of the key cap falls. Also, when the operator strikes one of the key switches 43 and 44 of the third and fourth rows, the depth-side of the key cap falls.

The operator of the keyboard unit, incidentally, usually places hands at the home position, and when each finger is moved to strike the key switches of each row, the operator usually strikes the key switches of the first row with his or her thumb and the key switches of the other rows with the other fingers. More specifically, for the first row, the end portion of the key cap on the operator-side of the key switch 41 tends to be struck with the thumb. For the second row, the finger tip is moved to the operator-side of the key cap to strike it. For the fourth and fifth rows, the finger tip is moved to the depth-side of the key cap to strike it.

Since the key switch 41 of the first row is the operator-side fall type where the operator-side of the key cap falls, the key switch performs the motion which is similar to the motion of a thumb which strikes the end portion of the key cap on the operator-side of the key switch 41. Further, since the key switch 42 of the second row is the operator-side fall type, the key switch performs the motion which is similar to the motion of a finger tip thumb which strikes the end portion of the key cap on the operator-side of the key switch 41. At this time, the upper surfaces of the key switches 41 and 42 of the first and second rows are inclined so as to be higher on the operator-side of the key cap than on the depth-side. For this reason, the operator can more easily strike the key switches.

Further, since the key caps of the key switches 43 and 44 of the third and fourth rows are the depth-side fall type, the key switches 43 and 44 perform the motion which is similar to the motion of the finger tip held in the home position and the strike the depth-side of the key cap. Therefore, the operator can strike these key switches with natural motion of fingers without feeling something wrong with the finger. In addition, the upper surfaces of the key caps of the key switches 43 and 44 of the third and fourth rows are inclined so as to be higher on the depth-side of the key cap than on the operator-side, so that the operator can more easily strike the key switches.

Furthermore, in the key switch 45 of the fifth row, when the key cap is struck, the distance of movement of the finger tip is longest. For this reason, in the key switch 45, the end portion on the operator-side of the key cap tends to be struck. Therefore, the key cap of the key switch 45 is rotated on its shaft 45*a* and lowers the operator-side of the key cap, so the key cap will perform the motion which is similar to the motion of the finger tip which strikes the end portion on the operator-side of the key cap. As a result, the operator can strike the key cap of the key switch 45 with natural motion of fingers without feeling something wrong with the finger.

Thus, in the keyboard unit of the third embodiment, the key caps of the key switches 41, 42 and 45 of the first, second and fifth rows are lowered on the operator-side of the key cap, and the key caps of the key switches 43 and 44 of the third and fourth row are lowered on the depth-side. Therefore, the downward rotation of each key cap can be matched with the motion of the finger tip of the operator. Accordingly, the keyboard unit can be constructed so that the operator does not feel something wrong with the finger when the operator strikes each key cap, while realizing the miniaturization and thinning of the keyboard unit. In other words, the operator can conduct a comfortable and reliable operation without making operational mistakes.

While the above description has been made of an example of the case where the key switches are arranged in 5 rows, the present invention is not limited to this example.

Figure 11:
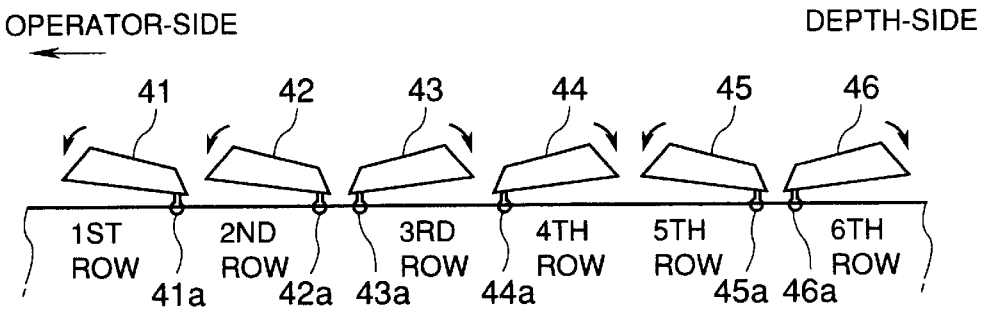
FIG. 11 is a schematic side view showing a modified keyboard unit according to the third embodiment.

For example, as shown in FIG. 11, the keyboard unit according to the present invention may be constructed so that it is provided with a key switch 46 of the sixth row and that the key cap of the key switch 46 rotates on a support shaft 46*a* and is lowered on the depth-side of the key cap.

Figure 12:
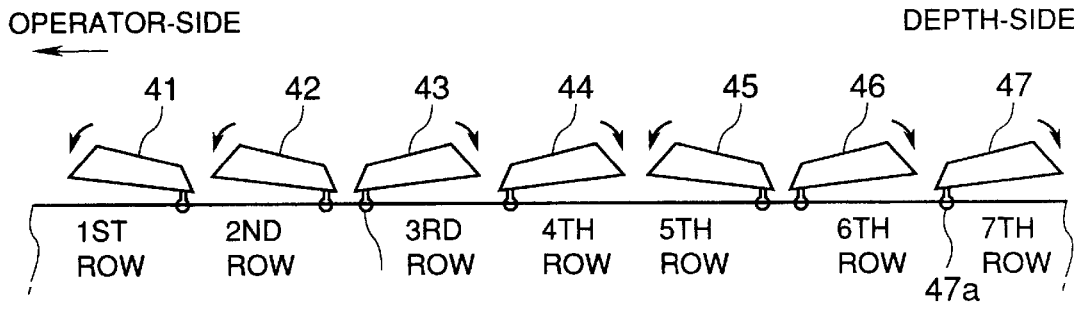
FIG. 12 is a schematic side view showing another modified keyboard unit according to the third embodiment.

Also, as shown in FIG. 12, the keyboard unit according to the present invention may be constructed so that it is provided with a key switch 46 of the sixth row of and a key switch 47 of the seventh row and that the respective key caps of the key switches 46 and 47 rotate on support shafts 46*a* and 47*a* and are lowered on the depth-side of the respective key caps.

Figure 13:
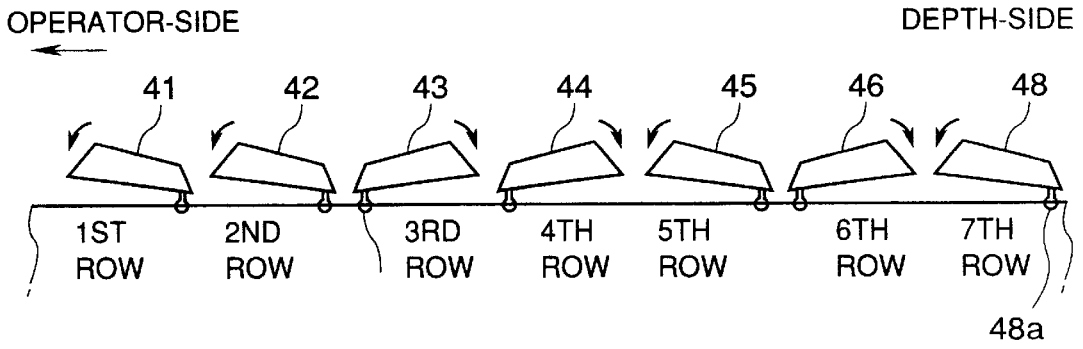
FIG. 13 is a schematic side view showing a still another modified keyboard unit according to the third embodiment.

In addition, as shown in FIG. 13, the keyboard unit according to the present invention may be constructed so that it is provided with a key switch 46 of the sixth row and a key switch 47 of the seventh row, the key cap of the key switch 46 rotates on a support shaft 46*a* and is lowered on the depth-side of the key cap, and the key cap of the key switch 47 rotates on a support shaft 47*a* and is lowered on the operator-side of the key cap.

Fourth Embodiment

Figure 14A:
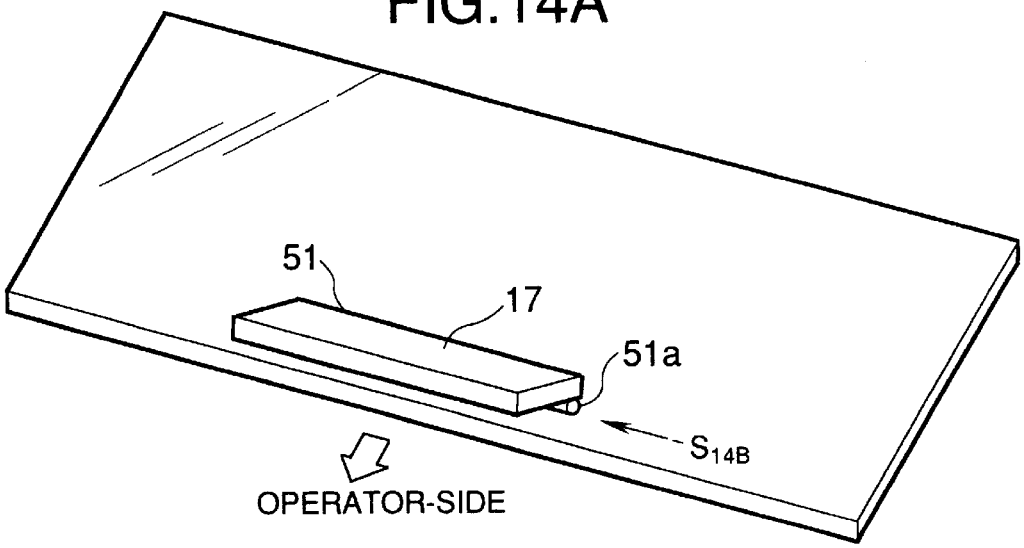
FIG. 14A is a perspective view schematically showing a keyboard unit according to a fourth embodiment of the present invention.
Figure 14B:
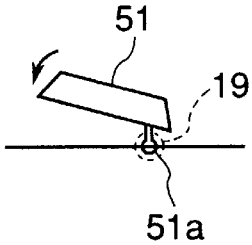
FIG. 14B is a schematic side view taken in a direction of an arrow $S_{14B}$ in FIG. 14A.

FIG. 14A is a perspective view schematically showing a keyboard unit according to a fourth embodiment of the present invention, and FIG. 14B is a schematic side view taken in a direction of an arrow $S_{14B}$ in FIG. 14A In the keyboard unit of the fourth embodiment, a plurality of key switches are arranged in, for example, 5 rows in accordance with a predetermined rule. The fourth embodiment differs from the above-described third embodiment only in that a wide space key 51 is arranged on the first row on the operator-side of the keyboard unit.

In the keyboard unit of the fourth embodiment, as shown in FIG. 14A, on the depth-side of the space key 51, there is provided with a bearing portion (not shown in FIGS. 14A and 14B) which supports the support shaft 51*a* of the key cap of the space key 51 so that of the key cap is rotatable on the support shaft 51*a*. Therefore, when the space key 51 is depressed by the operator, the space key 51 rotates on the support shaft 51*a* and is lowered on the operator-side of the key cap. The space key 51 has the same structure as the key switch in the above-described first or second embodiment. Also, the key cap of the space key 51, as shown in FIG. 14B, is inclined so as to be higher on the operator-side of the key cap than on the depth-side of the key cap.

Further, key switches other than the space key 51 may be constructed in the same way as the third embodiment. Also, each key cap may be lowered vertically while the upper surface of the key cap is kept horizontal. In addition, the other key switches on the same row as the space key 51, that is, the other key switches on the first row may have either a similar structure to the space key 51 or a different structure.

Generally, the frequency that the space key 51 is struck is very high. Therefore, it is considered that the space key 51 is arranged so as to be higher than the other keys to improve operability, however, this arrangement will become an obstacle to the thinning of the keyboard unit. The keyboard unit of the fourth embodiment is constructed so that the operator-side of the space key 51 is higher than the depth-side of the space key 51 and falls. Therefore, even if the space key 51 is arranged so as to be higher that other keys, the operator could easily touch the space key 51 with his or her thumb, and consequently, a comfortable and reliable operation could be performed.

Further, except for the above description, the fourth embodiment is the same as the third embodiment.

Fifth Embodiment

Figure 15A:
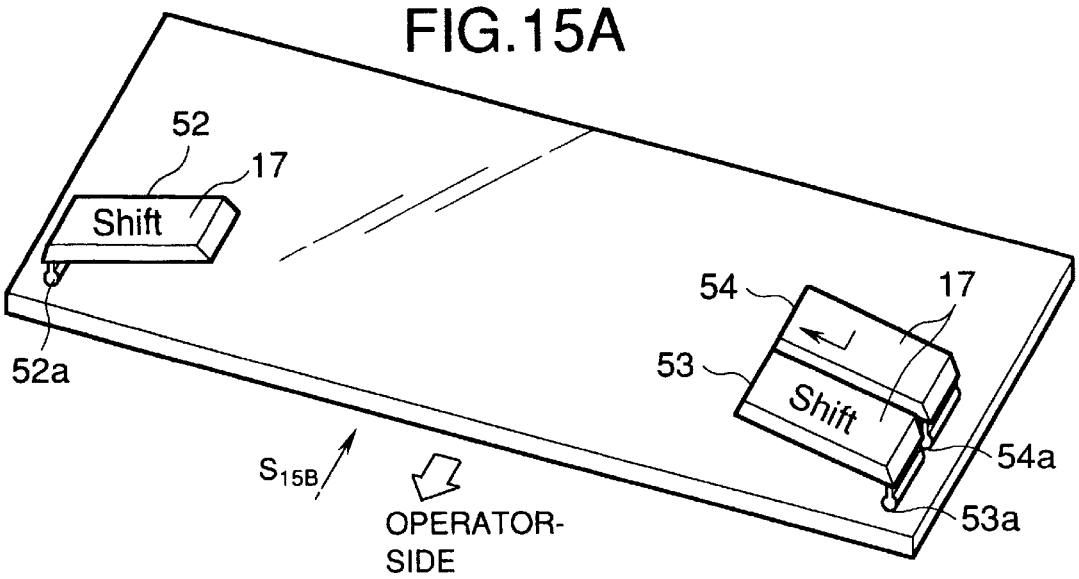
FIG. 15A is a perspective view schematically showing a keyboard unit according to a fifth embodiment of the present invention.
Figure 15B:
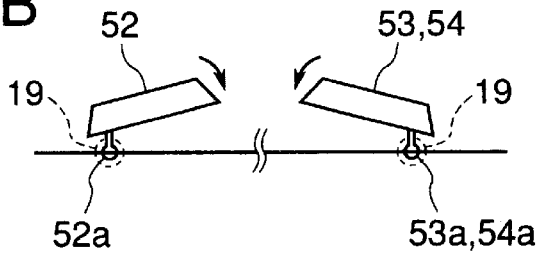
FIG. 15B is a schematic side view taken in a direction of an arrow $S_{15B}$ in FIG. 15A.

FIG. 15A is a perspective view schematically showing a keyboard unit according to a fifth embodiment of the present invention, and FIG. 15B is a schematic side view taken in a direction of an arrow $S_{15B}$ in FIG. 15A.

In the keyboard unit of the fifth embodiment, a plurality of key switches are arranged in, for example, 5 rows in accordance with a predetermined rule, and special key switches (large key switches) such as a shift key and a return key, are arranged on the left and right ends of each row, respectively.

In the keyboard unit of the fifth embodiment, as shown in FIGS. 15A and 15B, the bearing portion 19 (not shown in FIG. 15A) of the support shaft 52*a* of a shift key 52 arranged on the left end is provided on the left-side of the shift key 52, and this shift key 52 is supported by the bearing portion so as to be rotatable on the support shaft 52*a*.

Also, the respective bearing portions 19 (not shown in FIG. 15A) of the support shafts 53*a* and 54*a* of a shift key 53 and a return key 54 arranged on the right end are provided on the right-side of the shift key 53 and the return key 54, and the shift key 53 and the return key 54 are supported so as to be rotatable on the support shafts 53*a* and 54*a*, respectively. Therefore, when the shift key 52 is depressed by the operator, the shift key 52 is rotated in a clockwise direction when viewed from the operator-side as shown in FIG. 15B, that is, the free end of the shift key 52 on the center side of the keyboard unit is rotated downward on the support shaft 52*a*. Also, when the shift key 53 or the return key 54 is depressed by the operator, the shift key 53 or the return key 54 is rotated in a counterclockwise direction when viewed from the operator-side as shown in FIG. 15B, that is, the free end of the shift key 53 or the return key 54 on the center side of the keyboard unit is rotated downward on the support shaft 53*a* or 54*a*.

Generally, for these special key switches, the operator moves each finger from the home position to the special key switches. For this reason, when the shift key 52, the shift key 53 or the return key 54 is struck, the free end of each key cap (i.e., the center side of the keyboard unit) is depressed with the little finger. The keyboard unit of the fifth embodiment is constructed so that each key cap of the special key switches is rotated on an axis (i.e., support shaft) which is provided on the outer side of the keyboard unit and the inner portion of each special key with respect to the keyboard unit falls. Therefore, the direction, in which the key cap of each special key switch rotates, can be matched with the motion of the finger tip of the operator and a burden on the finger tip of the operator can be reduced, so that a comfortable and reliable operation can be performed.

While the fifth embodiment has been described with reference to special key switches such as the shift keys 52 and 53 and the return key 54, the present invention is not limited to these key switches. The present invention may also be applied to other key switches, such as a control key, as long as the key switches are arranged on the left or right end of each row.

Sixth Embodiment

Figure 16A:
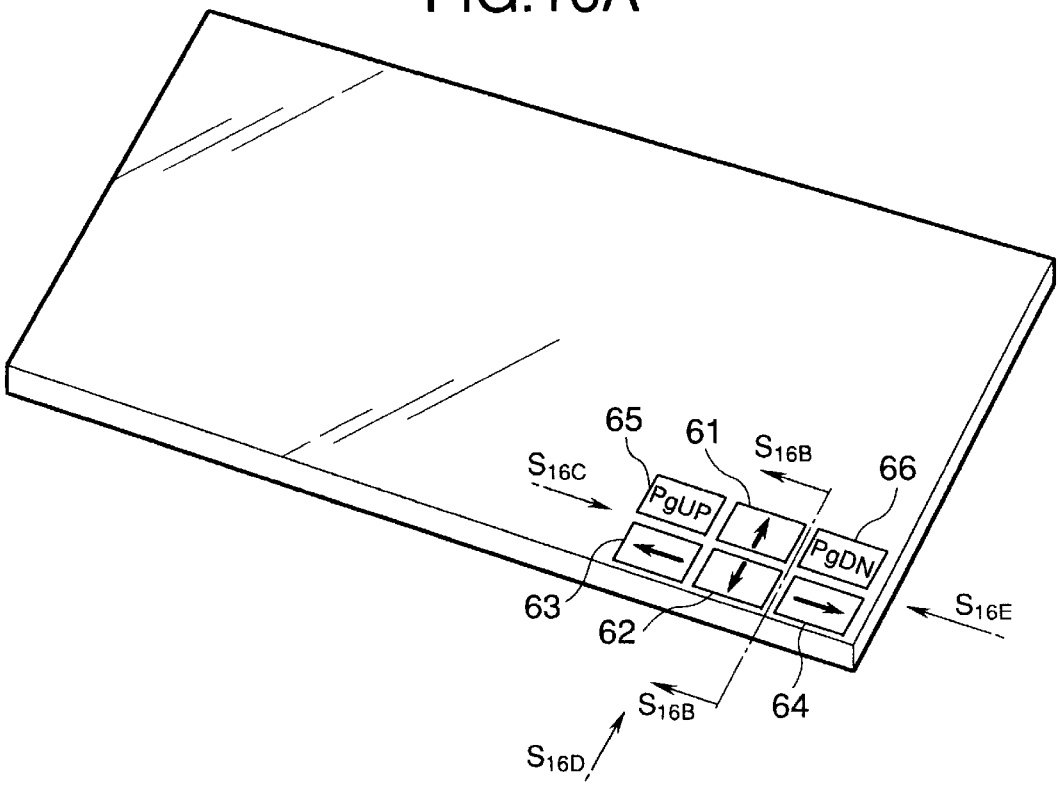
FIG. 16A is a perspective view showing a keyboard unit according to a sixth embodiment of the present invention.
Figure 16B:
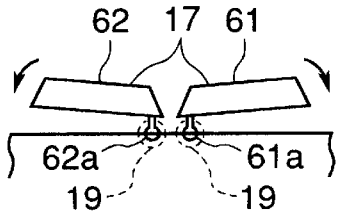
FIG. 16B is a schematic side view taken along a line $S_{16B}$—$S_{16B}$ in FIG. 16A.
Figure 16C:
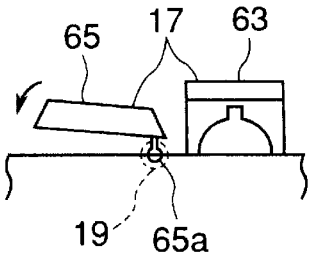
FIG. 16C is a schematic side view taken in a direction of an arrow $S_{16C}$ in FIG. 16A.
Figure 16D:
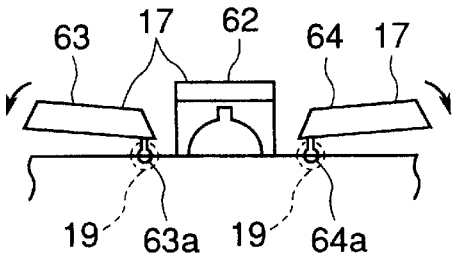
FIG. 16D is a schematic side view taken in a direction of an arrow $S_{16D}$ in FIG. 16A.
Figure 16E:
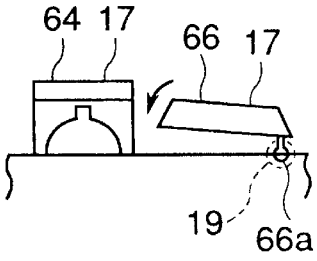
FIG. 16E is a schematic side view taken in a direction of an arrow $S_{16E}$ in FIG. 16A.

FIG. 16A is a perspective view schematically showing a keyboard unit according to a sixth embodiment of the present invention, FIG. 16B is a schematic side view taken along a line $S_{16B}$—$S_{16B}$ in FIG. 16A, FIG. 16C is a schematic side view taken in a direction of an arrow $S_{16C}$ in FIG. 16A, FIG. 16D is a schematic side view taken in a direction of an arrow $S_{16D}$ in FIG. 16A, and FIG. 16E is a schematic side view taken in a direction of an arrow $S_{16E}$ in FIG. 16A.

In the keyboard unit of the sixth embodiment, a plurality of key switches are arranged in accordance with a predetermined rule. This keyboard unit is equipped with an upward arrow key 61, a downward arrow key 62, a leftward arrow key 63, and a rightward arrow key 64, as arrow keys, and also is equipped with a PgUP key 65 and a PgDN (page down) key 66.

The upward arrow key 61 is used to move a cursor displayed on the display screen of an information processor in an up direction. Also, the downward arrow key 62 is used to move a cursor in a down direction. Likewise, the leftward arrow key 63 and the rightward arrow key 64 are used for moving a cursor in left and right directions, respectively. Furthermore, the PgUP key 65 is used to scroll the contents (e.g., text data and image data) displayed on the display screen in an up direction, and the PgDN key 66 is used to scroll the contents (e.g., text data and image data) displayed on the display screen in a down direction.

The key switches 61–66 have bearing portions (not shown in FIGS. 16A–16E) which support the support shafts 61*a*–66*a* thereof respectively so that the support shafts 61*a*–66*a* are rotatable. More specifically, the upward arrow key 61 has the bearing portion near the operator-side of the key cap, the downward arrow key 62 has the bearing portion near the depth-side of the key cap, the leftward arrow key 63 has the bearing portion near the right side of the key cap when viewed from the operator-side, and the rightward arrow key 64 has the bearing portion near the left side of the key cap when viewed from the operator-side. Also, the PgUP key 65 has the bearing portion near the operator-side of the key cap, and the PgDN key 66 has the bearing portion near the depth-side of the key cap.

Therefore, when the upward arrow key 61 is depressed by the operator, the key cap of the upward arrow key 61 rotates around the operator-side of the key cap and the depth-side of the key cap falls. Also, when the key cap of the downward arrow key 62 is depressed by the operator, the key cap of the downward arrow key 62 rotates around the depth-side of the key cap and the operator-side of the key cap falls.

When the key cap of the leftward arrow key 63 is depressed by the operator, the key cap rotates around the right side of the key cap and the left side of the key cap falls.

Also, when the key cap of the rightward arrow key 64 is depressed by the operator, the key cap rotates around the left side of the key cap and the right side of the key cap falls.

Furthermore, when the key cap of the PgUP key 65 is depressed by the operator, the key cap rotates around the right side of the key cap and the left side of the key cap falls. When the key cap of the PgDN key 66 is depressed by the operator, the key cap rotates around the left side of the key cap and the right side of the key cap falls.

The reason why the positions of the bearing portions for the key switches 61–66 are set as described above is that each of the key switches 61–66 lowers a side which matches the direction at which a cursor is moved or the direction at which a displayed content is scrolled. By constructing the key switches 61–66 in this way, the direction at which the operator tries to advance the cursor or the screen will match the direction in which the key switches 61–66 are lowered when struck. For this reason, the operator can strike these key switches 61–66 with natural motion and therefore can perform a comfortable and reliable operation.

While the keyboard unit of the sixth embodiment has been equipped with both the arrow keys and the page-up and page-down keys, the present invention may also be applied to the keyboard unit equipped with either the arrow keys or the page-up and page-down keys.

Seventh Embodiment

Figure 17:
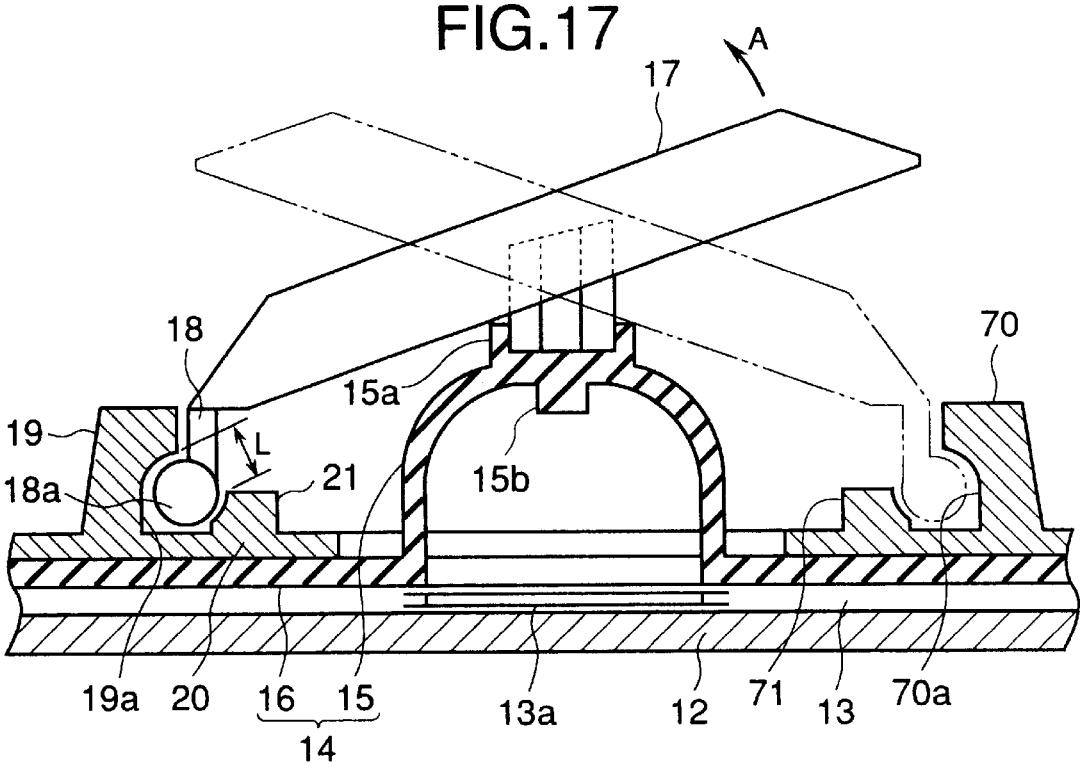
FIG. 17 is a vertical sectional view schematically showing a key switch according to a seventh embodiment of the present invention.

FIG. 17 is averticalsectional view schematically showing a key switch according to a seventh embodiment of the present invention.

Those structures in FIG. 17 that are identical to or correspond to the structures in FIG. 6 and FIG. 7 are assigned identical symbols. The seventh embodiment differs from the first embodiment in that each key switch has two bearing portions and that the support shaft of a key cap can be selectively and detachably fitted into either bearing portions.

As shown in FIG. 17, in addition to the bearing portion 19, another bearing portion 70 is provided on a cover sheet 20. Also, bearing grooves 70*a* (only one bearing groove 70*a* is shown in FIG. 17) are formed in the bearing portion 70, and stoppers 71 (only one stopper 71 is shown in FIG. 17) are provided at positions opposite the bearing grooves 70*a*, respectively. The bearing portion 70 and the stoppers 71 are provided opposite to the bearing portion 19 and the stoppers 21 across the dome portion 15. Also, the bearing portion 70 and the stoppers 71 are formed into the same shape as the bearing portion 19 and the stoppers 21.

Therefore, the support shafts 18*a* (only one support shafts 18*a* is shown in FIG. 17) of the key cap 17 can be fitted selectively and detachably into either the bearing portion 19 or the bearing portion 70.

Therefore, for a certain key switch, a portion which falls when the key cap 17 is struck can be changed by changing the bearing portion 19 engaged by the support shaft 18*a* to the bearing portion 70 or by changing the bearing portion 70 to the bearing portion 19. That is, for example, in a key switch, where the support shaft is fitted into the bearing portion on the depth-side of the switch so that operator-side of the key cap falls, the support shaft may also be fitted into the bearing portion on the operator-side so that the depth-side of the key cap falls.

At this time, if only the key cap 17 is formed symmetrically on both the side of the support shaft 18*a* and the opposite side, there is no possibility that the operator feels something wrong with the finger, because the configuration of the key cap 17 would remain unchanged even if the key cap 17 were rotated through an angle of 180 degrees.

According to the key switch of the seventh embodiment, as previously described, the bearing portions 19 and 70 and the stoppers 21 and 71 are provided at two opposite positions across the dome portion 15 of the click rubber 14, and also these members and the support shafts 18*a* of the key cap 17 are detachably formed. Therefore, after the key cap 17 has been detached from the bearing portion, the key cap 17 can be turned through an angle of 180 degrees and fitted again into the opposite bearing portion. Thus, the direction in which the key cap 17 is rotated and lowered can be changed. In this way, the key switch becomes easy for all operators to operate, and prevention of an unsuitable input operation and an input mistake can be realized.

In the seventh embodiment, while a description has been made of the case where the support shaft 18*a* is provided on the key cap 17 and also the bearing portions 19 and 70 are provided on the key switch base 20, these members may also be conversely provided.

Also, in the seventh embodiment, although a description has been made of the case where the bearing portions 19 and 70 and the stoppers 21 and 71 are provided at two positions, the bearing portions may also be provided at three or four positions around the dome portion 15 of the click rubber 14. In this case, the position at which the key cap 17 rotates and falls can be freely selected from, for example, the depth-side, the operator-side, the right side and the left side.

In the seventh embodiment, as previously described, the direction of the key cap 17 is turned through an angle of 180 degrees in order to change the direction in which the key cap 17 rotates and falls. In the case where the key cap 17 has no printing on its surface, as in the case of the space key in a keyboard unit, there will be no problem when the key cap is turned through an angle of 180 degrees. However, in the case where the key cap 17 includes characters or the like on the upper surface, the directions of characters or the like become opposite when the key cap is turned through an angle of 180 degrees.

Figure 18:
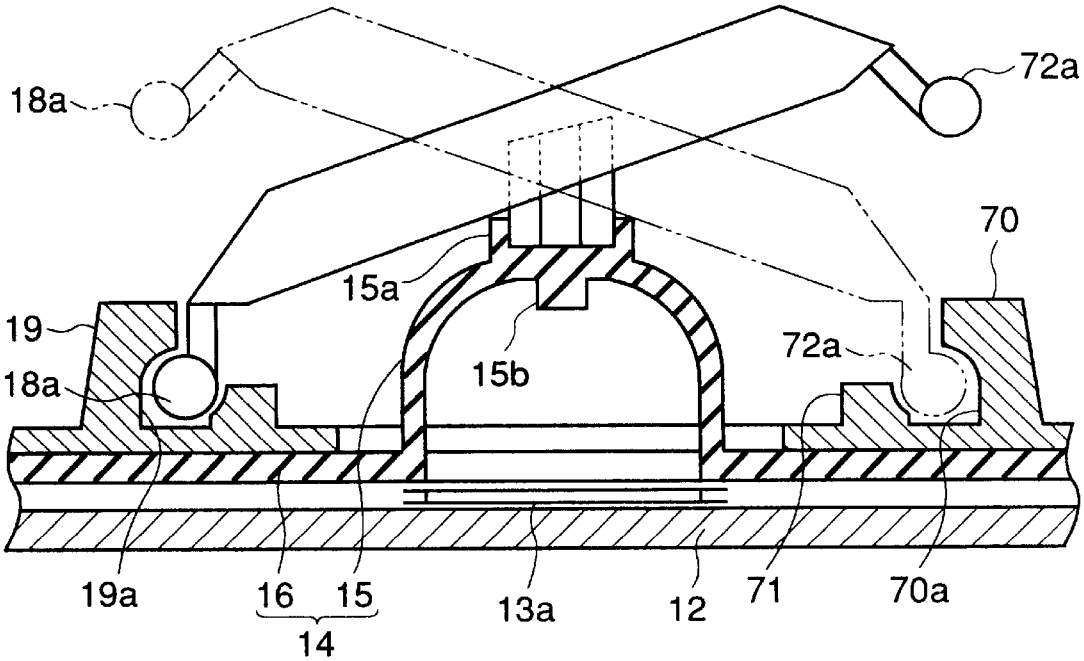
FIG. 18 is a vertical sectional view schematically showing a modified key switch according to the seventh embodiment.

Therefore, if the key switch is constructed as described below, there would be no possibility that the direction of a character would become opposite, even when the character is printed on the surface of the key cap 17, and consequently, the direction in which the key cap rotates and falls can be changed. For example, as shown in FIG. 18, the key cap 17, in addition to the support shaft 18*a* provided on one end thereof, is provided with similar support shafts 72*a* as the support shafts 18*a* at the other end. In the case where the direction in which the key cap 17 rotates and falls is changed in the state where the support shaft 18*a* is fitted in the bearing portion 19, the support shaft 18*a* is first detached from the bearing portion 19 and then the support shaft 72*a* is fitted into the bearing portion 70. In this way, the direction in which the key cap 17 rotates and falls can be changed without turning the key cap 17 through an angle of 180 degrees. Therefore, even if the character is printed on the upper surface of the key cap 17, there would be no possibility that the direction of the character would become opposite.

Eighth Embodiment

FIGS. 19A–19D are vertical sectional views showing a key switch according to an eighth embodiment of the present invention. FIG. 20 is an exploded perspective view showing the key switch of FIGS. 19A–19D.

As shown in FIGS. 19A–19D and FIG. 20, the key switch 81 of the eighth embodiment is provided on a base plate 82. The key switch 81 has a membrane sheet 83 provided on the base plate 82, a click rubber 84 provided on the membrane sheet 83, an actuator 86 and a key cap 87.

The base plate 82 is made of a metal plate or the like. The base plate 82 is equipped with two fixing portions 82*a* and 82*b*, which rise substantially vertically, for each key switch 81. As shown in FIG. 20, the fixing portions 82*a* and 82*b* have openings 82*c* and 82*d*, respectively.

The membrane sheet 83 is made of a thin film sheet. The membrane sheet is equipped with openings 83*b* and 83*c* provided at positions corresponding to the fixing portions 82*a* and 82*b* of the base plate 82. The membrane sheet 83 is equipped with an electric contact 83*a* which is electrically connected when the key cap 87 of the key switch 81 is depressed.

The click rubber 84 consists of a flexible and elastic insulator such as rubber. The click rubber 84 has openings 84*a* and 84*b* provided at positions corresponding to the fixing portions 82*a* and 82*b* of the base plate 82, and the dome portion 85 formed so as to cover the electric contact 83*a* within the membrane sheet 83. The dome portion 85 has a protrusion 85*b* provided on the back side of the top portion 85*a*.

The actuator 86 is integrally formed, for example, from resin material. As shown in FIG. 20, the actuator 86 has an opening 86*a* at the center portion thereof, and the dome portion 85 of the click rubber 84 is inserted into the opening 86*a*. Also, the actuator 86 has a support shaft 86*b* provided parallel to the base plate 82, at one end thereof. The other end of the actuator 86 is equipped with a fixing protrusion 86*c* formed so as to be fitted into the opening 82*d* of the fixing portion 82*b* of the base plate 82. Further, the actuator 86 is equipped with anti-slip-out pawls 86*d* provided near both sides of the opening 86*a*, and a stopper 86*e* provided between the opening 86*a* and the support shaft 86*b*. The details of the stopper 86*e* will be described later.

A key cap 87 is formed integrally into a generally square and inverted box shape, for example, from resin material. One end of the key cap 87 is equipped with bearing portions 87*a* into which the support shaft 86*b* of the actuator 86 is fitted. Furthermore, the key cap 87 is equipped with anti-slip-out pawls 87*b* which engage the anti-slip-out pawls 86*d* of the actuator 86.

Figure 19A:
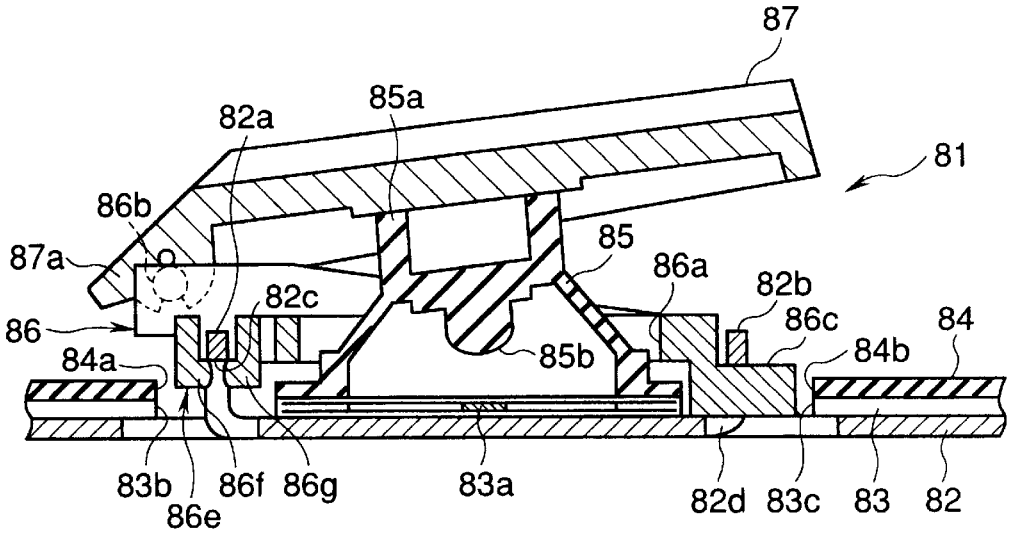
FIGS. 19A–19D are vertical sectional views showing the operation of a key switch according to an eighth embodiment of the present invention.
Figure 20:
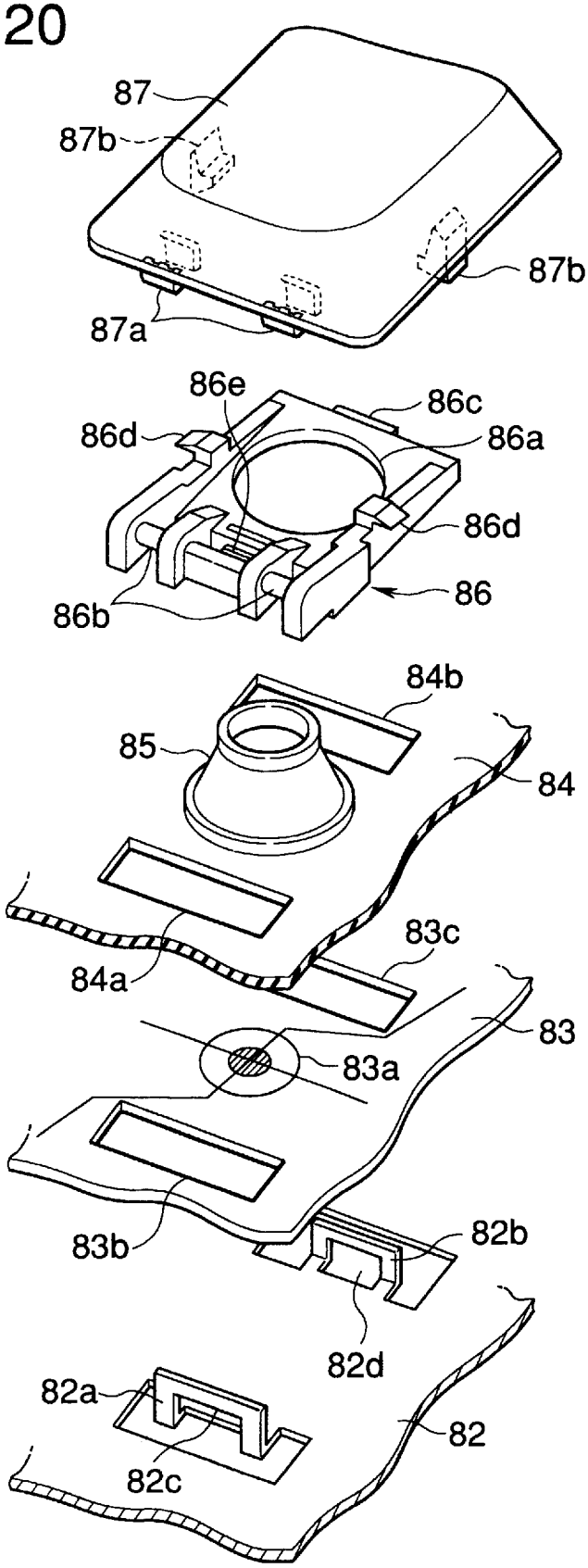
FIG. 20 is an exploded perspective view showing the key switch of FIGS. 19A–19D.

In the key switch with the above-described structure, as shown in FIG. 19A, the membrane sheet 83 is mounted on the base plate 82, and the click rubber 84 is mounted on the membrane sheet 83. Also, the key cap 87 is positioned above the click rubber 84, and the back surface of the key cap 87 is in contact with the top portion 85*a* of the dome portion 85. With the elastic restoring force of the click rubber 84, the key cap 87 is urged upward.

In the key switch 81, the actuator 86 is interposed between the click rubber 84 and the key cap 87, that is, between the base plate 82 and the key cap 87. The actuator 86 engages in the state where the protrusion 86*c* of the actuator 86 is fitted loosely into the opening 82*d* of the fixing portion 82*b* of the base plate 82, and the stopper 86*e* of the actuator 86 is fitted into the opening 82*b* of the other fixing portion 82*a*. With this arrangement, the engaging portion between the protrusion 86*c* and the fixing portion 82*b* of the base plate 82 functions as a rotational axis of the actuator 86, and the end portion of the actuator 86 on the side of the support shaft 86*b* can be rotated on the rotational axis in a range limited by the stopper 86*e* of the actuator 86 and the opening 82*c* of the fixing portion 82*a*.

The stopper 86*e* has two protrusions 86*f* and 86*g* (shown in FIG. 19A) which are opposed with each other, and the spacing between the two protrusions 86*f* and 86*g* is formed so as to be smaller than the plate thickness of the fixing portion 82*a*. The reason for this is that the protrusions 86*f* and 86*g* of the stopper 86*e* are fitted into the opening 82*c* of the fixing portion 82*a* and also are press fitted into the fixing portion 82*a* from above the fixing portion 82*a* by making use of elastic deformation of the stopper 86*e*.

Figure 19B:
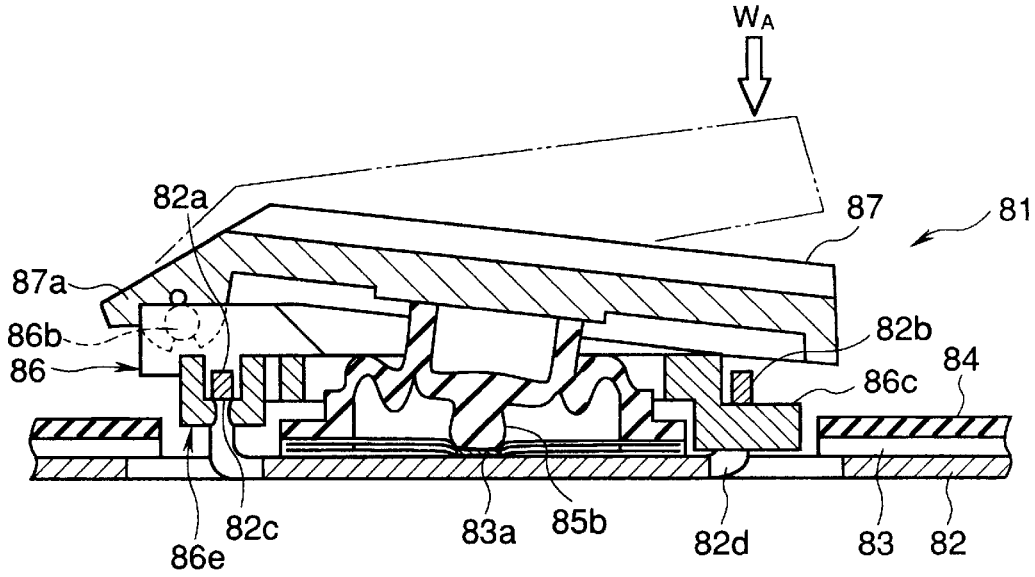

Also, in the actuator 86, the support shaft 86*b* is fitted into the bearing portions 87*b* of the key cap 87 and also the anti-slip-out pawl 86*d* of the actuator 86 engages with the anti-slip-out pawl 87*b* of the key cap 87. With this arrangement, the engaging portions between the support shaft 86*b* and the bearing portions 87*b* function as a rotational axis of the key cap 87, and the key cap 87 can be rotated on the rotational axis within a range limited by the anti-slip-out pawls 86*d* and 87*b*, as shown in FIG. 19B. Further, the engagement between the actuator 86 and the key cap 87 is performed by making use of elastic deformation of the actuator 86 and the key cap 87. For this reason, the bearing portion 87*a* of the key cap 87 is provided with a slit for press fitting the support shaft 86*b* of the actuator 86 into the bearing portion 87*a*.

Thus, the actuator 86 and the key cap 87 are respectively constructed so that the actuator 86 is rotatable around the axis provided on one side and the key cap 87 is rotatable around the axis provided on the other side. Therefore, by an engagement between the fixing portion 82*a* and the stopper 86*e* and engagements between the anti-slip-out pawls 86*d* and the anti-slip-out pawls 87*b*, the actuator 86 and the key cap 87 would not slip out upward even if the key cap 87 is urged upward by the elastic restoring force of the click rubber 84. Further, the fixing portion 82*a*, the stopper 86*e*, the anti-slip-out pawls 86*d*, and the anti-slip-out pawls 87*b* are positioned so that the rotational range (rotational angle) of the actuator 86 becomes about ⅙ to ⅓ of the rotational range (rotational angle) of the key cap 87.

A description will next be made of the operation of the key switch 81 with the above-described structures in the case where the key cap 87 is depressed.

As shown in FIG. 19B, when the vicinity of the free end of the key cap 87 is depressed in a direction of an arrow $W_A$, the key cap 87 of the key switch 81, in the same way as the conventional key cap, is rotated downward on the support shaft 86*b* of the actuator 86 in a clockwise direction and therefore the dome portion 85 of the click rubber 84 is buckled and deformed. The buckling deformation of the dome portion 85 causes the protrusion 85*b* of the inner surface of the dome portion 85 to press against the electric contact 83*a* of the membrane sheet 83. Consequently, in the key switch, the electric contact 83*a* is electrically connected. When the finger of the operator is removed from the key cap 87, the key cap 87 is lifted by the elastic restoring force of the dome portion 85 of the click rubber 84 and return to the state of FIG. 19A.

Figure 19C:
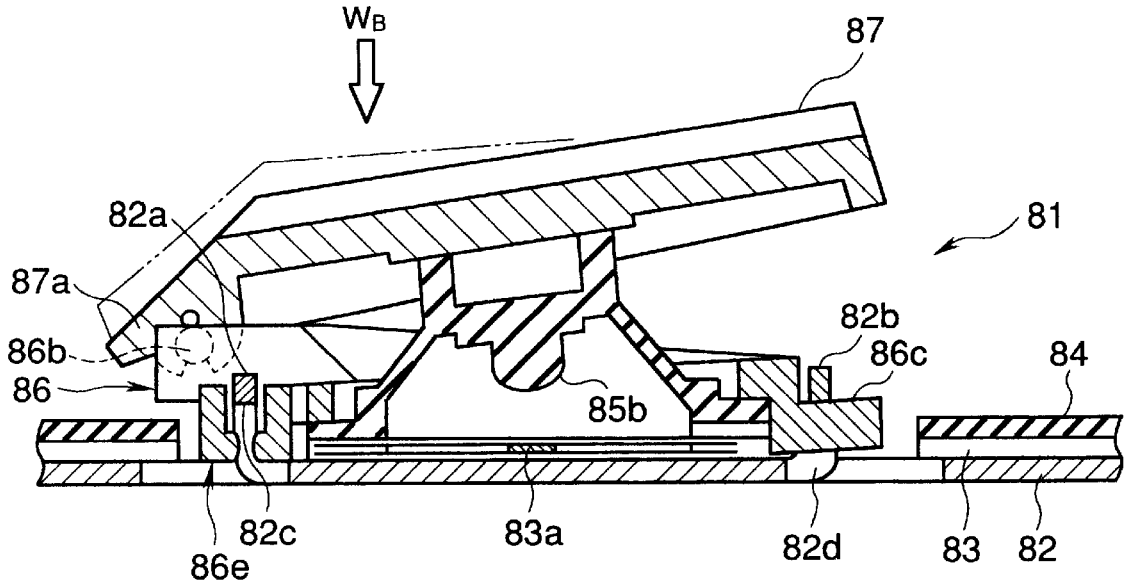
Figure 19D:
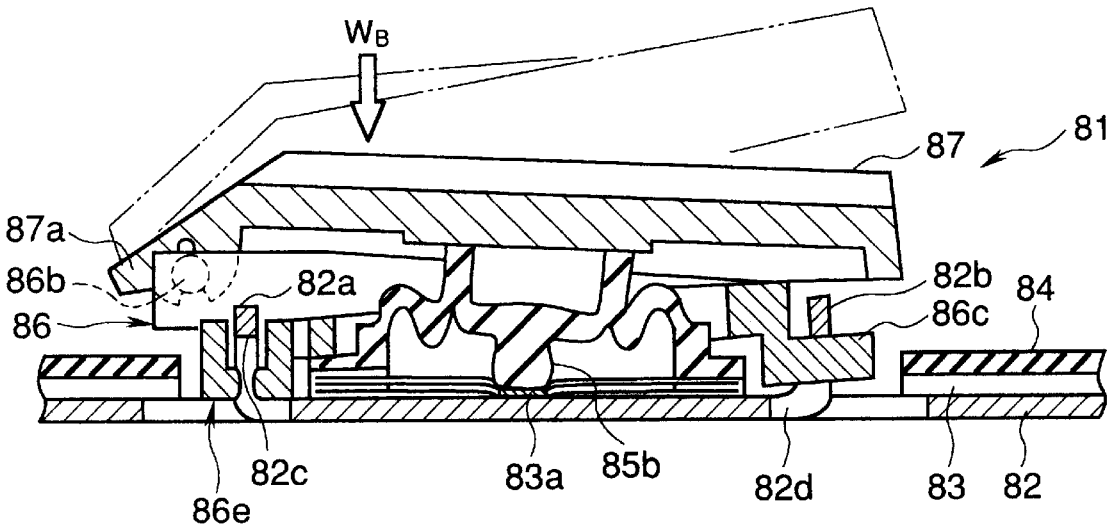

On the other hand, as shown in FIG. 19C, when the vicinity of the bearing portion 87*a* of the key cap 87 is depressed in a direction of an arrow $W_B$, the actuator 86 of the key switch 81 is first swung downward on the rotational axis (near the engagement between the fixing protrusion 86*c* and the fixing portion 82*a* of the base plate 82) in the counterclockwise direction. When the actuator 86 rotates and falls until it comes in contact with the base plate 82, the key cap 87 is rotated on the support shaft 86*b* of the actuator 86 in the clockwise direction and falls. The rotation and fall of the key cap 87 causes the click rubber 84 to be buckled, and in the same way as the above-described case, the electric contact 83*a* of the membrane sheet 83 is electrically connected.

When the finger of the operator is removed from the key cap 87, the key cap 87 is lifted by the elastic restoring force of the dome portion 85 of the click rubber 84. Also, since the key cap 87 is lifted, the actuator 86 which engages with the key cap 87 is rotated upward on the rotational axis near the engaging portion between the fixing protrusion 86*c* and the fixing portion 82*a* of the base plate 82. In this way, the key cap 87 and the actuator 86 return to the state of FIG. 19A.

According to the key switch 81 of the eighth embodiment, as previously described, the actuator 86 is interposed between the base plate 82 and the key cap 87, and also the actuator 86 is rotated in the opposite direction of the key cap 87. Therefore, according to this key switch, when the key cap 87 is depressed, the key cap 87 is rotated downward on the support shaft 86*b* of the actuator 86 and also the actuator 86 is rotated downward on the rotational axis near the engaging portion between the fixing protrusion 86*c* and the fixing portion 82*a* of the base plate 82. Therefore, for example, even when the vicinity of the fixed end of the key cap 87 is depressed, there would be no possibility that the stroke of the key cap 87 felt by the finger of the operator would be extremely reduced, as compared with the case where the rotational end of the key cap 87 is depressed.

Therefore, in the key switch 81, even if the operator struck the fixed end portion of the key cap 87 with the same force as the case where the rotational end portion of the key cap 87 is struck, the impact force that is applied to the finger of the operator could be suppressed. Also, in the key switch 81, even when the fixed end portion of the key cap 87 is struck, the operator can feel a certain stroke with his or her finger, because the actuator 86 is rotated downward. Consequently, the key switch 81 becomes easy for the operator to operate.

In addition, the key switch of the eighth embodiment is constructed so that the rotational angle of the actuator 86 is about ⅙ to ⅓ of the rotational angle of the key cap 87. With this arrangement, the balance between the rotational angle of the key cap 87 and the rotational angle of the actuator 86 becomes suitable when keys are struck and therefore suppresses the impact force that is applied to the finger of the operator when the fixed end portion of the key cap 87 is depressed, while ensuring a suitable stroke which is comfortable for the operator.

Ninth Embodiment

Figure 21:
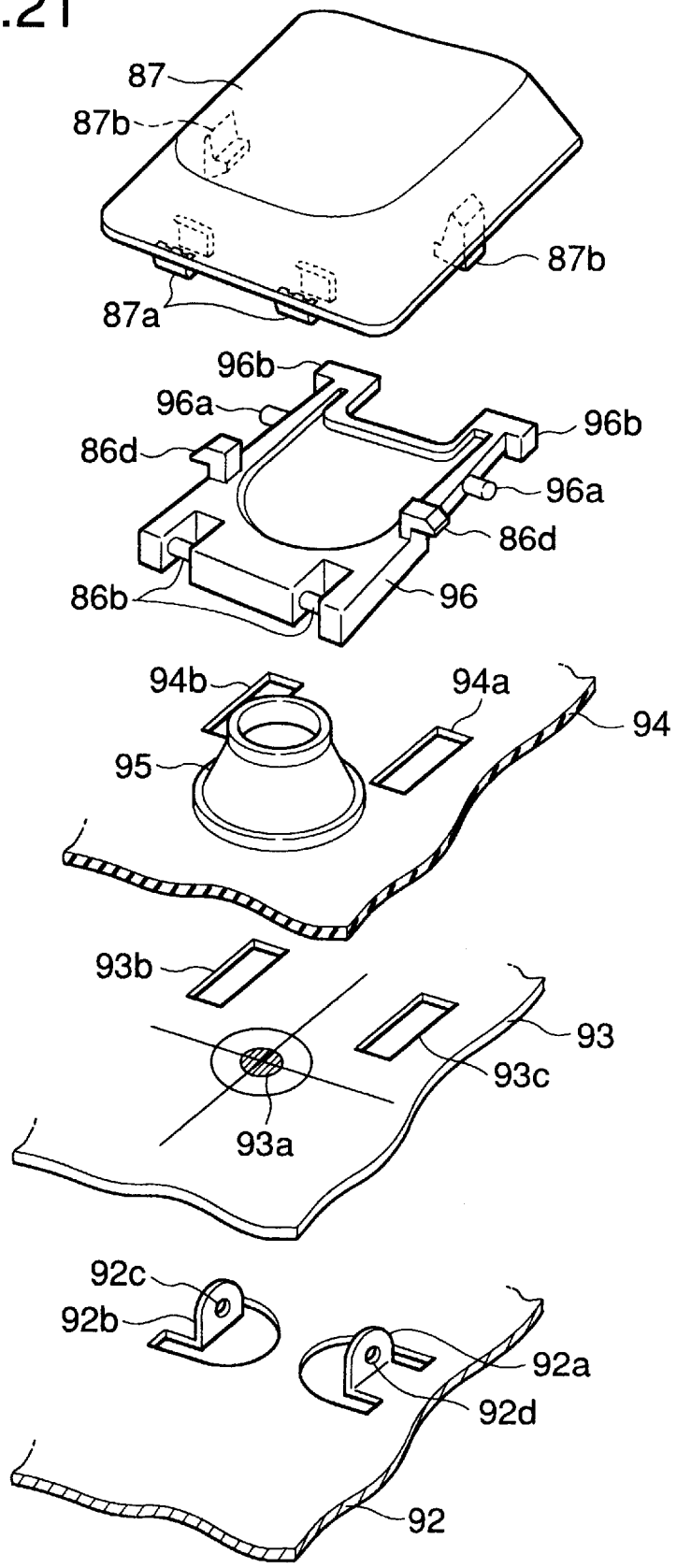
FIG. 21 is an exploded perspective view showing a key switch according to a ninth embodiment of the present invention.
Figure 22:
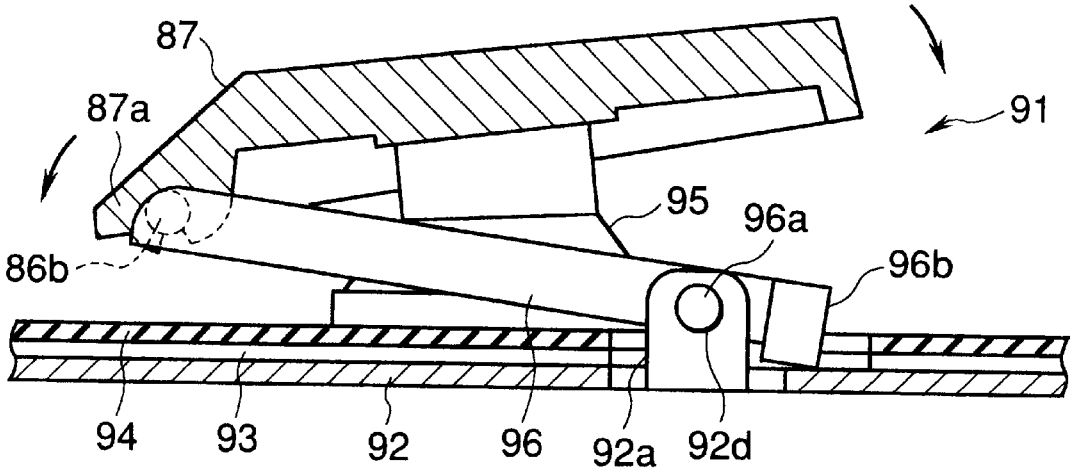
FIG. 22 is a vertical sectional view showing the key switch of FIG. 21.

FIG. 21 is an exploded perspective view showing a key switch according to a ninth embodiment of the present invention. FIG. 22 is a vertical sectional view showing the key switch of FIG. 21.

Those structures in FIG. 21 and FIG. 22 that are identical to or correspond to structures in FIGS. 19A–19D and FIG. 20 are assigned identical symbols.

A key switch 91 in the ninth embodiment differs from that of the above-described eighth embodiment in the structure of the base plate and the actuator.

As shown in FIG. 21, a base plate 92 is equipped with two fixing portions 92*a* and 92*b*. In this embodiment, the fixing portions 92*a* and 92*b* are provided so that the each surface of the fixing portions 92*a* and 92*b* faces in a direction perpendicular to the direction in which the surface of the fixing portion 82*a* in the eighth embodiment faces. Also, the fixing portions 92*a* and 92*b* have holes 92*c* and 92*d* in the rising portions, respectively.

An actuator 96 is provided with support shafts 96*a* at two positions instead of the fixing protrusion 86*c* in the above-described eighth embodiment. Also, the actuator 96 is provided with rotation stoppers 96*b* near the support shafts 96*a* instead of the stopper 86 in the above-described eighth embodiment. Further, the support shafts 96*a* are provided near the side opposite to the support shafts 86*b*, and the rotation stoppers 96*b* are provided on an end portion near the side opposite to the support shafts 86*b*. Also, the openings 93*b* and 93*c* in the membrane sheet 93 and the openings 94*a* and 94*b* in the click rubber 94 are provided at positions corresponding to the fixing portions 92*a* and 92*b* of the base plate 92.

In the key switch 91 of the ninth embodiment, as shown in FIG. 22, the support shafts 96*a* of the actuator 96 are fitted into the holes 92*c* and 92*d* of the fixing portions 92*a* and 92*b* of the base plate 92. The engagement between the actuator 96 and the base plate 92 is performed by making use of elastic deformation of the actuator 96. The actuator 96 is freely rotatable with the engaging portion as an axis of rotation. The rotation stoppers 96*b* of the actuator 96 come in contact with the base plate 92, thereby preventing the slipping-out of the actuator 96 and limiting the rotational angle of the actuator 96.

Figure 23A:
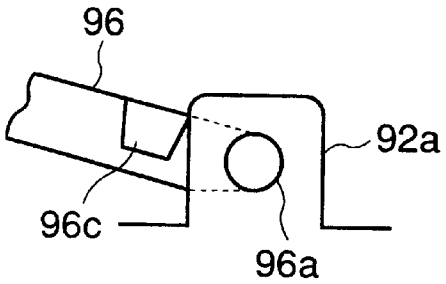
FIGS. 23A and 23B are a vertical sectional view and a perspective view showing a modified key switch according to the ninth embodiment.
Figure 23B:
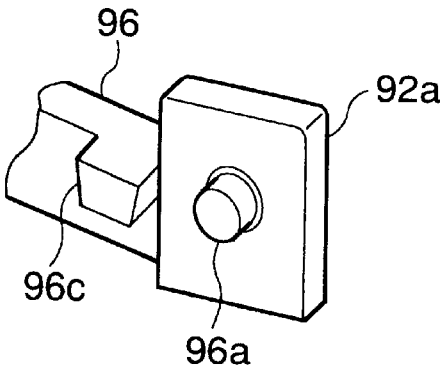

Furthermore, as shown in FIGS. 23A and 23B, the rotation stoppers 96*c* (only one stopper 96*c* is shown in FIGS. 23A and 23B), in place of the stoppers 96*b* of FIG. 22, may also be provided so as to protrude near the support shaft 96*a*. When the actuator 96 is rotated on the support shaft 96*a*, the rotation stoppers 96*c* of FIGS. 23A and 23B are brought into contact with the fixing portions 91*a* and 92*b* of the base plate 92, whereby the anti-slip-out and rotational angle limitation of the actuator 96 are performed.

As described above, in the key switch 91 of the ninth embodiment, even if the fixed end portion of the key cap 97 is depressed, there would be no possibility that the stroke of the key cap 97 felt by the finger of the operator would be extremely reduced. Consequently, the key switch 91 suppresses the impact force that is applied to the finger of the operator and also becomes easy for the operator to operate.

Tenth Embodiment

Figure 24:
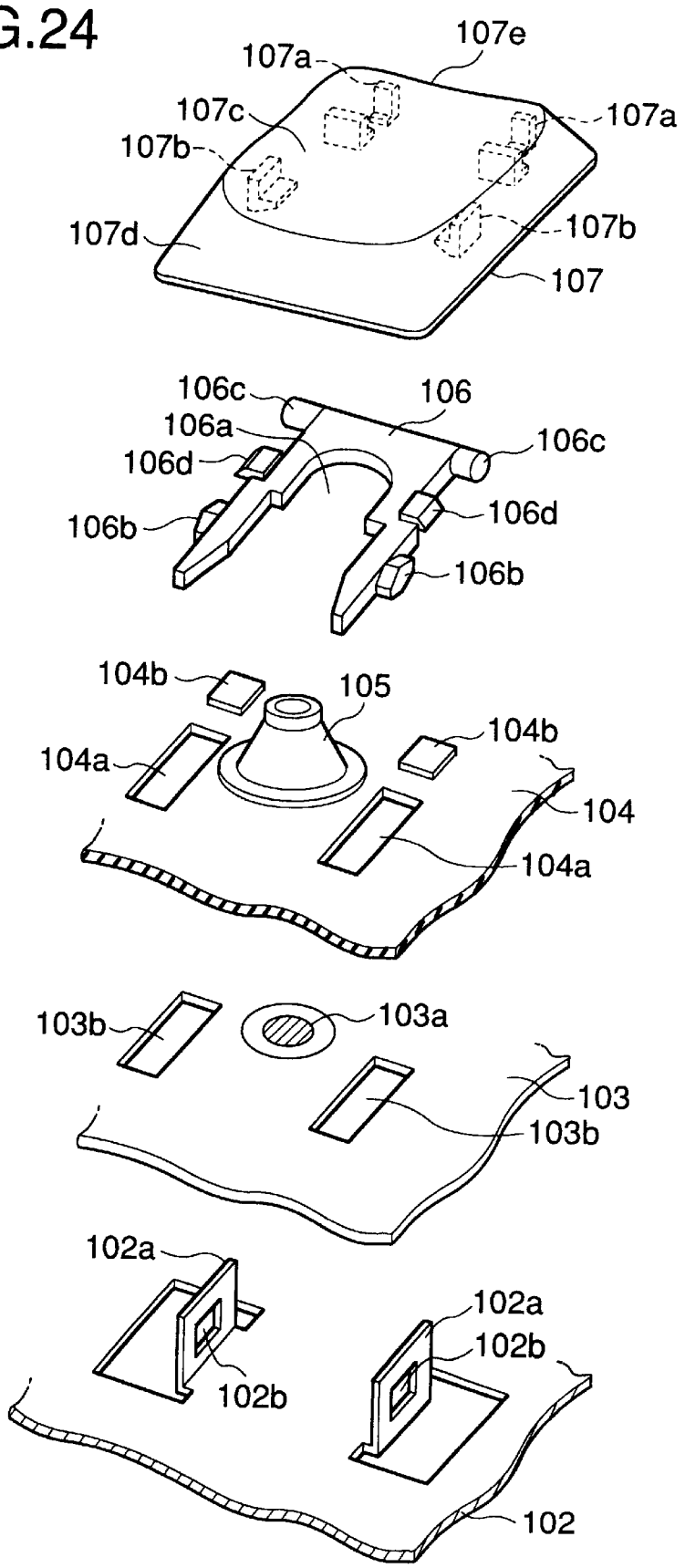
FIG. 24 is an exploded perspective view showing a key switch according to a tenth embodiment of the present invention.
Figure 25A:
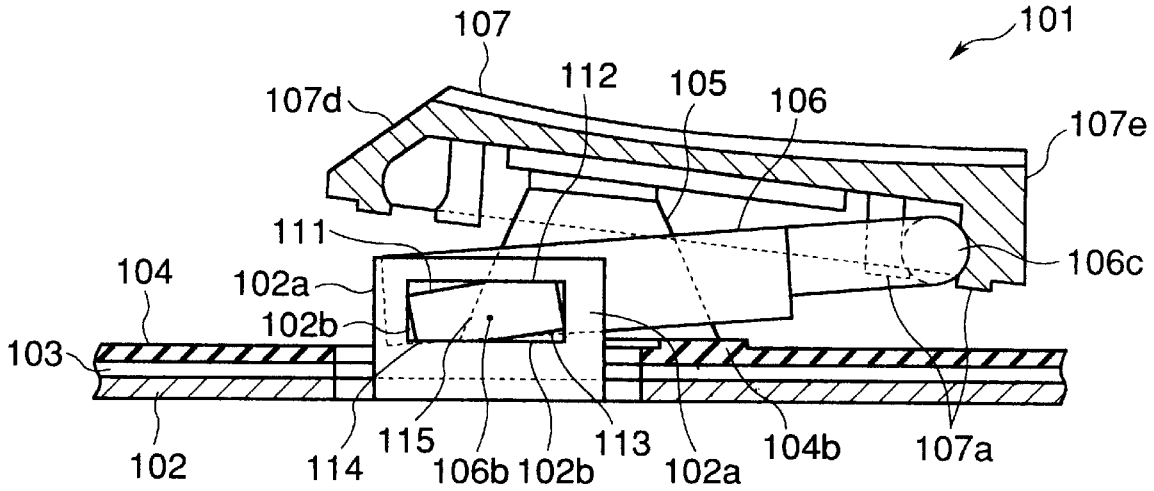
FIG. 25A is a vertical sectional view showing the key switch of FIG. 24.
Figure 25B:
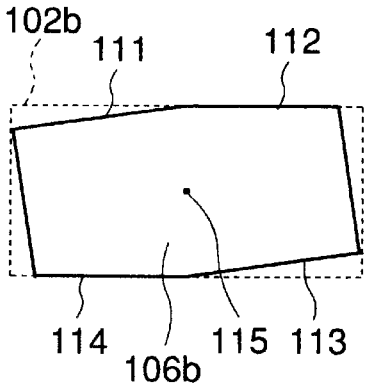
FIGS. 25B and 25C are enlarged views showing a support shaft shown in FIG. 25A.
Figure 25C:
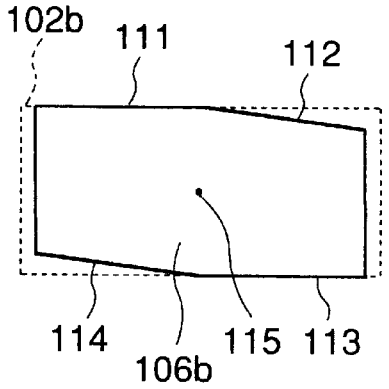

FIG. 24 is an exploded perspective view showing a key switch according to a tenth embodiment of the present invention, FIG. 25A is a vertical sectional view showing the key switch of FIG. 24, and FIGS. 25B and 25C are enlarged views showing a support shaft of an actuator shown in FIG. 25A. Those structures in FIG. 24 and FIGS. 25A–25C that are identical to or correspond to structures in FIGS. 19A–19D and FIG. 20 are assigned identical symbols.

Referring to FIG. 24, a base plate 102 is equipped with a couple of fixing portions 102*a* facing each other. The fixing portions 102*a* are provided at the same positions as the fixing portions 92*a* and 92*b* in the above-described ninth embodiment. Also, the fixing portions 102*a* have rectangular holes 102*b* in the rising portions, respectively. Further, a click rubber 104 is formed integrally with two spring portions 104*b* for urging an actuator 106 upward.

The actuator 106 is generally formed into a Uletter shape, and the center portion thereof has a cutout 106*a* into which the dome portion 105 of the click rubber 104 is inserted. Also, the actuator 106 is provided with support shafts 106*b* at two positions. The actuator 106 is further provided with engaging shafts 106*c* on a side of a free end opposite to the support shafts 106*b*. Between the support shafts 106*b* and the engaging shaft 106*c*, anti-slip-out pawls 106*d* are provided.

The back surface (i.e., lower surface) of the key cap 107 is equipped with shaft engaging portions 107*a* and anti-slip-out pawls 107*b*. The shaft engaging portions 107*a* are formed at positions corresponding to the engaging shafts 106*c* of the actuator 106. The anti-slip-out pawls 107*b* of the key cap 107 engage with the anti-slip-out pawls 104*d* of the actuator 106. In the key cap 107 of the tenth embodiment, the orientation of the ceiling portion 107*c* (which is contacted directly by the finger of the operator) with respect to the actuator 106 is opposite the key cap of the above-described eighth or ninth embodiment. That is, in the key cap 107 on the tenth embodiment, the shaft engaging portions 107*a* are provided on the depth-side (the side of a portion 107e) opposite to the operator-side (the side of a portion 107*d*) of the keyboard unit, and as shown in FIG. 25A, the portion 107*d* is arranged so as to be higher than the portion 107*e*. On the other hand, in the key cap of the above-described eighth or ninth embodiment, the operator-side is formed so as to be lower than the opposite side.

In FIGS. 25A–25C, the support shaft 106*b* of the actuator 106 has two inclined portions 111 and 112 on the upper surface. Likewise, the support shaft 106*b* has two inclined portions 113 and 114 on the lower surface. In the state where the support shafts 106*b* of the actuator 106 are fitted into the rectangular holes 102*b* of the fixing portions 102*a*, the actuator 106 is rotatable until any one of the inclined portions 111 and 112 comes in contact with the upper surface of the rectangular hole 102*b* or any one of the inclined portions 113 and 114 comes in contact with the lower surface of the rectangular hole 102*b*, as shown in FIGS. 25A and 25B. The rotational center 115 of the support shaft 106*b* is aligned with the center of the fixing holes 102*b* of the fixing portions 102*a*.

In the state shown in FIG. 25A, that is, in the state where the key cap 107 is not depressed, the actuator 106 is lifted up by the key cap 107 and the dome portion 105. Therefore, the inclined portion 112 of the support shaft 106*b* is in contact with the upper surface of the rectangular hole 102*b*, and the inclined portion 114 of the support shaft 106*b* is in contact with the lower surface of the rectangular hole 102*b*.

Figure 26A:
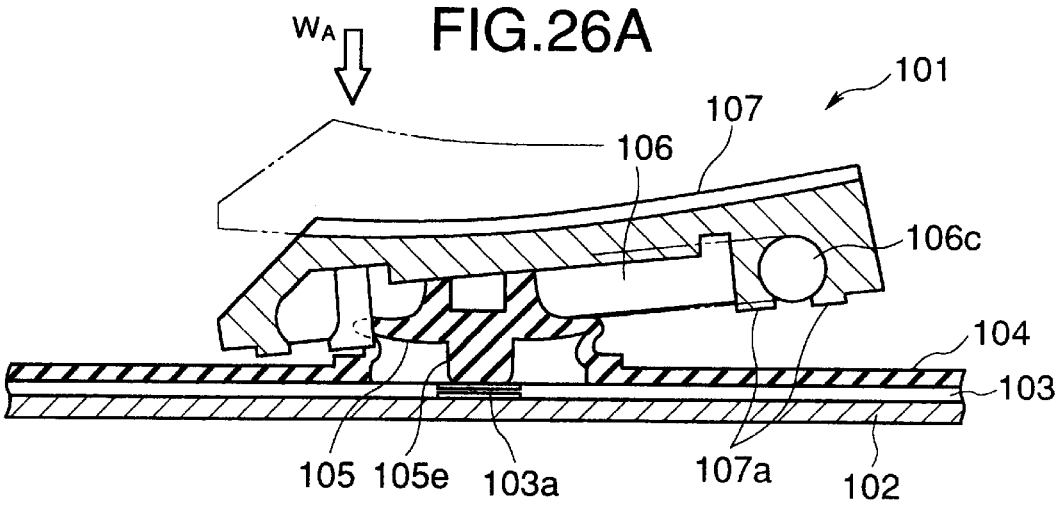
FIGS. 26A–26C are vertical sectional views showing the operation of the key switch of FIG. 24.
Figure 26B:
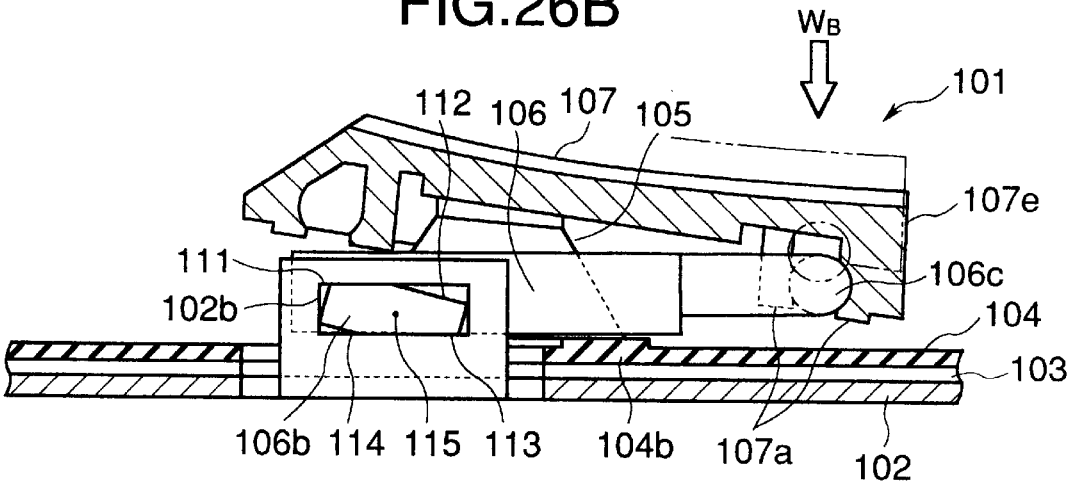
Figure 26C:
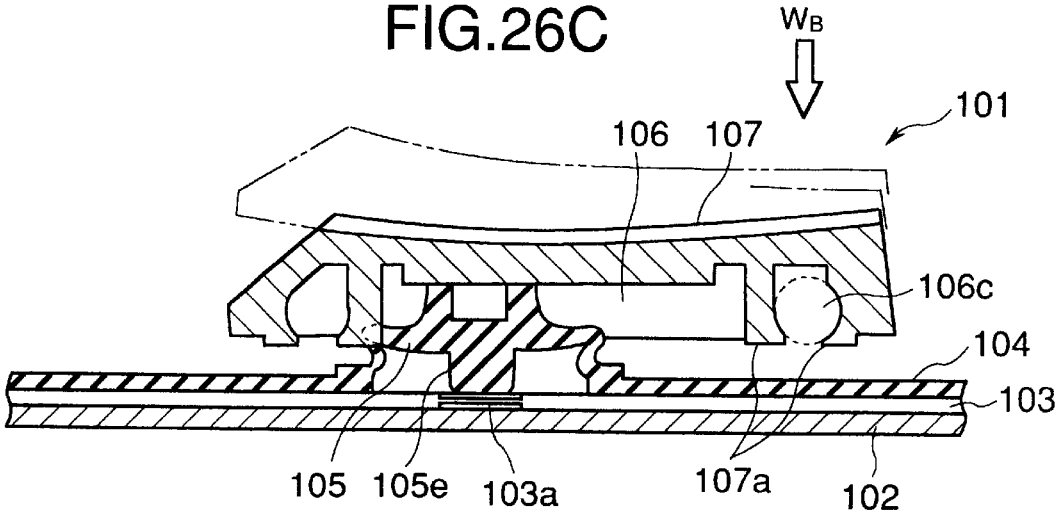

A description of the operation when the key cap 107 is depressed will next be made in reference to FIGS. 26A–26C and FIG. 25C. FIGS. 26A–26C are side sectional views showing how the key switch 101 in the tenth embodiment is operated.

As shown in FIG. 26A, if the vicinity of the free end of the key cap 107 (on the operator-side) is depressed in a direction of an arrow $W_A$, the key cap 107 of this key switch 101, in the same way as the conventional key cap, is rotated downward on the rotational axis (namely shaft 106*c*) of the actuator 106 in the counterclockwise direction and therefore the dome portion 105 of the click rubber 104 is buckled and deformed. The buckling deformation of the dome portion 105 causes the protrusion 105*e* of the dome portion 105 to press against the electric contact 103*a* within the membrane sheet 103. Consequently, in this key switch 101, the electric contact 103*a* is electrically connected. If the finger of the operator is removed from the key cap 107, the key cap 107 is lifted by the elastic restoring force of the dome portion 105 and return to the state shown in FIG. 26A.

On the other hand, as shown in FIG. 26B, if the depth-side 107*e* of the key cap 107, i.e., the vicinity of the fixed end of the key cap 107 is depressed in a direction of an arrow $W_B$, the actuator 106 of the key switch 101 is first rotated downward on the rotational axis 115 of the support shaft 104 in the clockwise direction. The actuator 106 rotates and falls until the inclined portion 111 of the support shaft 106*b* of the actuator 106 comes in contact with the upper surface of the rectangular hole 102*a* of the base plate 102 and also the inclined surface 113 comes in contact with the lower surface of the rectangular hole 102*a* (FIG. 25C). At this time, the actuator 106 is pressed against the spring portions 104*b*, as shown in FIG. 26B.

Subsequently, as shown in FIG. 26C, the key cap 107 is rotated on the support shaft 106*c* of the actuator 106 in the clockwise direction and falls. The rotation and fall of the key cap 107 causes the dome portion 105 to be buckled, and the electric contact 103*a* within the membrane sheet 103 is electrically connected.

If the finger of the operator is removed from the key cap 107, the key cap 107 is lifted by the elastic restoring force of the dome portion 105. Also, the actuator 106 is rotated upward on the rotational axis 115 of the support shaft 104*b* by the lifting of the key cap 107 and the urging force of the spring portion 104*b* of the click rubber 104. In this way, the key switch 101 returns to the state shown in FIG. 26A.

The elastic restoring force of the dome portion 105 is gradually reduced with the lapse of time. The spring portions 104*b* of the click rubber 104 fulfill a role of compensating for a reduction in the elastic restoring force of the dome portion 105. Therefore, the key switch and the keyboard unit using this key switch can have durability by providing the spring portions 104*b*.

In the key switch 101 of the tenth embodiment constructed as described above, even if the vicinity of the fixed end portion of the key cap 107 is depressed, there would be no possibility that the stroke of the key cap 107 felt by the finger of the operator would be extremely reduced. Consequently, the key switch 101 suppresses the impact force that is applied to the finger of the operator and also becomes easy for the operator to operate.

Also, in the tenth embodiment the support shaft 106*b* has both a function as the rotational axis of the actuator 106 and a function of regulating rotation of the actuator 106, so the number of members required of the actuator 106 can be reduced and a compact structure can be obtained.

Further, the configuration of the support shaft 106*b* is not limited to the above-described shaft. For example, the support shaft 104 does not always have straight-shape inclined portions but it may also have various shapes if they can functionally regulate rotation.

Figure 27:
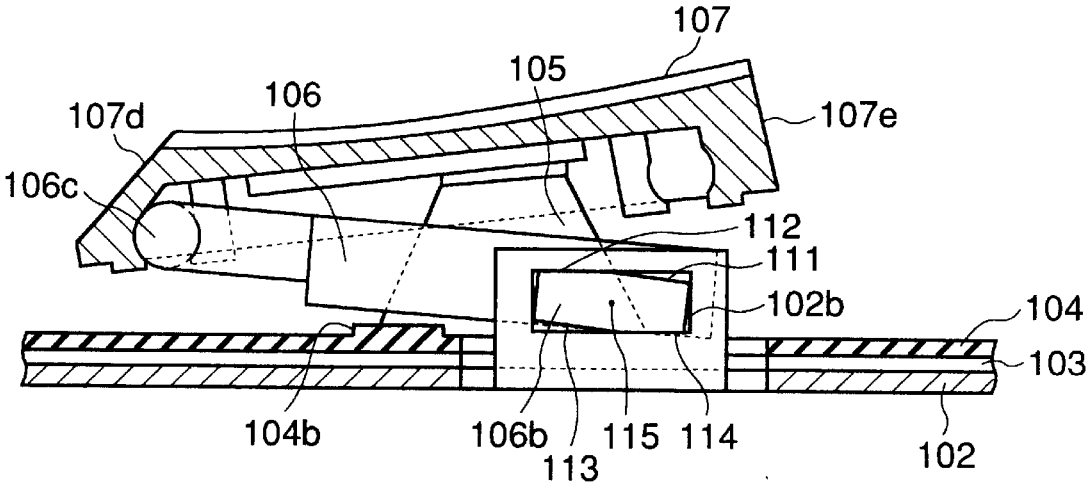
FIG. 27 is a sectional view showing a modified key switch according to the tenth embodiment.

FIG. 27 is a sectional view showing a modification of the tenth embodiment. In the key switch of this modification, the orientation of the key cap is opposite the key switch 101 in the key switch of FIG. 25A. In this modification, the orientation of the key cap 107 can easily be changed by providing the shaft engaging portion 107*a* of the key cap 107 either on the operator-side (left side in the figure) or on the depth-side side (right side in the figure). In this way, when key switches are arrayed on a keyboard unit, it becomes possible to easily to realize an array which is easy for operators to operate, for example, a sculpture slop shape.

Figure 28:
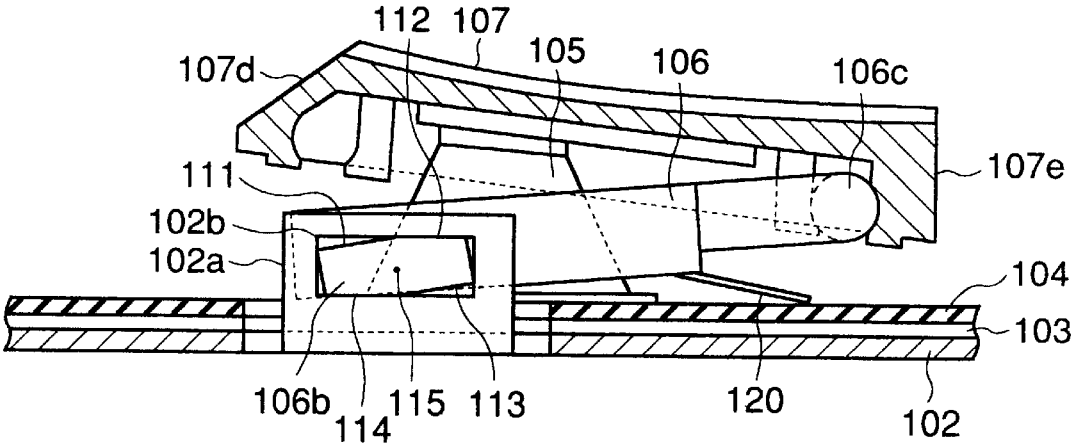
FIG. 28 is a sectional view showing another modified key switch according to the tenth embodiment.

FIG. 28 is a sectional view showing another modification of the tenth embodiment. This modification differs from that of FIG. 25A only in the respect that the spring portion 104*b* in FIG. 25A is replaced by a plate spring 120 for pushing up the actuator 106.

Figure 29:
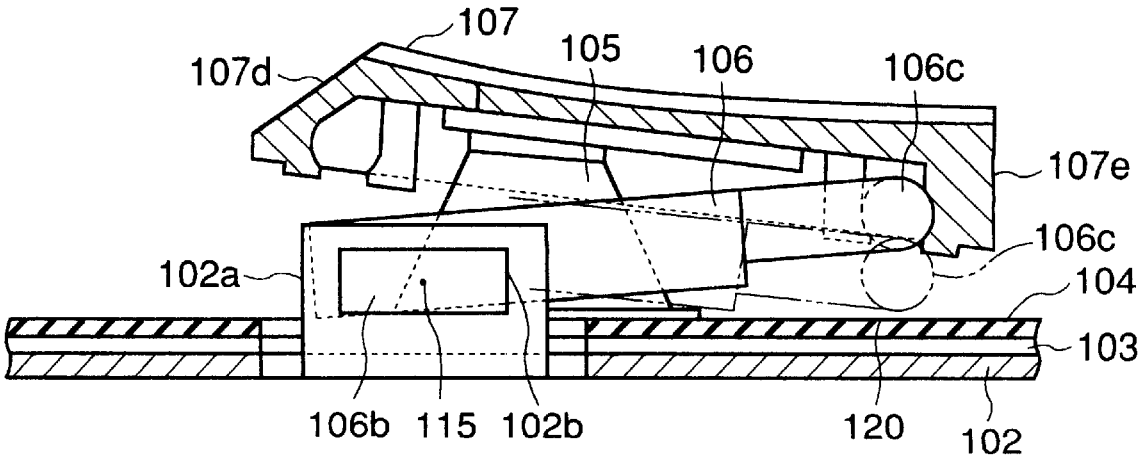
FIG. 29 is a sectional view showing a still another modified key switch according to the tenth embodiment.

FIG. 29 is a sectional view showing another modification of the tenth embodiment. In this modification, the fixing protrusions 106*b* are fixed to the fixing portions 102*a* of the base plate 102 so that the actuator 106 is fixed in the inclined state as shown in FIG. 29 by the solid line. When the actuator 106 is bent downward by depressing the key cap 107, the actuator 106 is bent as shown in FIG. 29 by the one-dotted chain line and urged upward by elastic restoring force of the actuator 106. When the key cap 107 is not depressed, the actuator 106 returns the inclined state as shown in FIG. 29 by the solid line.

Further, a keyboard unit may also be constructed by employing the key switches of the above-described embodiments. In this case, a reliable input operation in the keyboard unit is rendered possible by employing the key switch which suppresses impact force that is applied to the finger of the operator and which also is easy for the operator to operate.

Also, in the above-described key switches, not only the key cap 107 but the actuator 106 can be rotated and therefore the rotational angle of the key cap 107 from the depression of the key cap 107 to the connection of the electric contact is reduced compared with the key switch where only the key cap 107 is rotatable. Therefore, if the keyboard unit is constructed by employing the key switches of this embodiment, it is possible to reduce the stroke of the entire key switch, that is, the stroke on the rotational side of the key cap 107, and consequently, a further reduction in the thickness of the keyboard unit can be realized.

What is claimed is:

1. A keyboard unit, comprising:

a base plate;

an electric contact provided o n said base plate;

a cover sheet covering said base plate and having an opening;

an elastic dome portion formed on said base plate so as to cover said electric contact, said dome portion protruding through said opening of said cover sheet and over an upper surface of said cover sheet;

a first engaging portion provided on said cover sheet; and a key cap having a second engaging portion which engages with said first engaging portion, and a third engaging portion which engages with said dome portion, said key cap being cantilevered so as to be rotatable on said second engaging portion;

wherein, when said key cap is depressed, said key cap is rotated downward on said second engaging portion and said dome portion is elastically deformed so that an inner surface of said dome portion presses against said electric contact, and when said key cap is not depressed, deformation of said dome portion is removed so that said inner surface of said dome portion is separated from said electric contact and said key cap is rotated upward on said second engaging portion by said dome portion.

2. The keyboard unit of claim 1, further comprising:

a membrane sheet containing said electric contact and disposed between said base plate and said cover sheet.

3. The keyboard unit of claim 2, further comprising:

an elastic sheet disposed between said membrane sheet and said cover sheet and formed integrally with said dome portion.

4. The keyboard unit of claim 3, wherein said cover sheet is formed integrally with said first engaging portion.

5. The keyboard unit of claim 4, wherein said first engaging portion is a bearing portion;

said keyboard unit further comprising a protruding stopper formed on said cover sheet and facing said first engaging portion so that said second engaging portion of said key cap is fitted into a space between said first engaging portion and said protruding stopper.

6. The keyboard unit of claim 1, wherein said dome portion has a top portion having a recess; and said third engaging portion of said key cap is fitted into said recess of said top portion.

7. The keyboard unit of claim 1, further comprising a fourth engaging portion provided on said cover sheet, said second engaging portion of said key cap being selectively engagable with either said first engaging portion or said fourth engaging portion;

wherein, if said second engaging portion of said key cap is disengaged with said first engaging portion and is engaged with said fourth engaging portion, and the third engaging portion of said key cap is engaged with said dome portion, said key cap is cantilevered so as to be rotatable on said second engaging portion, and wherein when said key cap is depressed, said key cap is rotated downward on said second engaging portion and said dome portion is elastically deformed so that an inner surface of said dome portion presses against said electric contact, and when said key cap is not depressed, deformation of said dome portion is removed so that said inner surface of said dome portion is separated from said electric contact and said key cap is rotated upward on said second engaging portion by said dome portion.

8. The keyboard unit of claim 1, further comprising a fourth engaging portion provided on said cover sheet and disposed opposite to said first engaging portion;

wherein said key cap has a fifth engaging portion disposed opposite to said second engaging portion, said fifth engaging portion of said key cap being adapted to engage with said fourth engaging portion; and wherein, if said fifth engaging portion of said key cap is engaged with said fourth engaging portion, and said second engaging portion is disengaged with said first engaging portion; and the third engaging portion of said key cap is engaged with said dome portion, said key cap is cantilevered so as to be rotatable on said fifth engaging portion, and wherein when said key cap is depressed, said key cap is rotated downward on said fifth engaging portion and said dome portion is elastically deformed so that an inner surface of said dome portion presses against said electric contact, and when said key cap is not depressed, deformation of said dome portion is removed so that said inner surface of said dome portion is separated from said electric contact and said key cap is rotated upward on said fifth engaging portion by said dome portion.

9. A keyboard unit, comprising:

a base plate;

an electric contact provided on said base plate;

a cover sheet covering said base plate and having an opening;

an elastic dome portion formed on said base plate so as to cover said electric contact, said dome portion protruding through said opening of said cover sheet and over an upper surface of said cover sheet;

a first engaging portion provided on said cover sheet;

a key cap having a second engaging portion which engages with said first engaging portion, and a third engaging portion which engages with said dome portion, said key cap being cantilevered so as to be rotatable on said second engaging portion;

a slide member having a first end which is connected to said key cap so that said slide member is rotatable on said first end, and a second end which is slidable on said cover sheet; and a guide member for guiding said second end of said slide member on said cover sheet;

wherein, when said key cap is depressed, said key cap is rotated downward on said second engaging portion and said dome portion is elastically deformed so that an inner surface of said dome portion presses against said electric contact, and when said key cap is not depressed, deformation of said dome portion is removed so that said inner surface of said dome portion is separated from said electric contact, and said key cap is rotated upward on said second enaging portion by said dome portion.

10. A keyboard unit, comprising:

a base plate;

a cover sheet covering said base plate and having a plurality of openings; and a plurality of key switches arranged in a plurality of rows from an operator-side near an operator, toward a depth-side which is opposite of the operator-side;

each of said plurality of key switches comprising:

an electric contact provided on said base plate;

an elastic dome portion formed on said base plate so as to cover said electric contact, said dome portion protruding through a respective one of said plurality of openings of said cover sheet and over an upper surface of said cover sheet;

a first engaging portion provided on said cover sheet; and a key cap having a second engaging portion which engages with said first engaging portion, and a third engaging portion which engages with said dome portion, said key cap being cantilevered so as to be rotatable on said second engaging portion;

wherein, when said key cap is depressed, said key cap is rotated downward on said second engaging portion and said dome portion is elastically deformed so that an inner surface of said dome portion presses against said electric contact, and when said key cap is not depressed, deformation of said dome portion is removed so that said inner surface of said dome portion is separated from said electric contact and said key is rotated upward on said second engaging portion by said dome portion; and wherein said plurality of key switches includes an operator-side fall type key switch, the first engaging portion of which is disposed on the depth-side with respect to said key cap of said operator-side fall type key switch, and a depth-side fall type key switch, the first engaging portion of which is disposed on the operator-side with respect to said key cap of said depth-side fall type key switch.

11. The keyboard unit of claim 10, wherein said plurality of key switches are arranged in such a way that an imaginary envelop curve, which links highest points of said key caps arranged in the plurality of rows from the operator-side to the depth side, has a sculpture slope shape.

12. The keyboard unit of claim 10, wherein:

said row of operator-side fall type key switches includes a first row of key switches and a second row of key switches from the operator-side; and said row of depth-side fall type key switches includes a third row of key switches from the operator-side.

13. The keyboard unit of claim 10, wherein:

said plurality of key switches comprise a first through fifth rows of key switches from the operator-side;

the key switches of said first row, said second row and said fifth row are the operator-side fall type key switches; and the key switches of said third row and said fourth row are the depth-side fall type key switches.

14. The keyboard unit of claim 10, wherein:

said plurality of key switches comprise a first through sixth rows of key switches from the operator-side;

the key switches of said first row, said second row and said fifth row are the operator-side fall type key switches; and the key switches of said third row, said fourth row and said sixth row are the depth-side fall type key switches.

15. The keyboard unit of claim 10, wherein:

said plurality of key switches comprise a first through seventh rows of key switches from the operator-side;

the key switches of said first row, said second row and said fifth row are the operator-side fall type key switches; and the key switches of said third row, said fourth row, said sixth row and said seventh row are the depth-side fall type key switches.

16. The keyboard unit of claim 10, wherein said plurality of key switches comprise a first through seventh rows of key switches from the operator-side;

the key switches of said first row, said second row, said fifth row and said seventh row are the operator-side fall type key switches; and the key switches of said third row, said fourth row, said sixth row are the depth-side fall type key switches.

17. The keyboard unit of claim 10, wherein said plurality of key switches comprise a space key in a first row of key switches from the operator-side;

said space key is the operator-side fall type key switch.

18. The keyboard unit of claim 10, wherein said plurality of key switches further comprises:

a right-side fall type key switch, the first engaging portion of which are disposed on a left-side with respect to said key caps when viewed from the orerator-side, respectively; and a left-side fall type key switch, the first engaging portion of which are disposed on a right-side with respect to said key caps when viewed from the operator-side, respectively.

19. The keyboard unit of claim 10, wherein said plurality of key switches further comprises:

a downward arrow key switch which is an operator-side fall type key switch, the first engaging portion of which is disposed on the depth-side with respect to said key cap of said downward arrow key switch; and an upward key switch adjacent to the depth-side of said downward arrow key switch, which is a depth-side fall type key switch, the first engaging portion of which is disposed on the operator-side with respect to said key cap of said depth-side fall type key switch;

a rightward arrow key switch which is a right-side fall type key switch, the first engaging portion of which is disposed on a left-side with respect to said key caps when viewed from the operator-side; and a leftward arrow key switch which is a left-side fall type key switch, the first engaging portion of which is disposed on a right-side with respect to said key caps when viewed from the operator-side.

20. The keyboard unit of claim 10, wherein said plurality of key switches further comprises:

a page-down key switch which is the operator-side fall type key switch; and a page-up key switch which is the depth-side fall type key switch.

21. A keyboard unit, comprising:

a base plate;

an electric contact provided on said base plate;

an elastic dome portion formed on said base plate so as to cover said electric contact;

an actuator having a supported portion which is supported on said base plate so that said actuator is able to be swung on said supported portion, and a first engaging portion which is opposite to said supported portion; and a key cap having a second engaging portion which engages with said first engaging portion of said actuator so that said key cap is cantilevered to be rotatable on said second engaging portion of said actuator;

wherein, when said key cap is not depressed, said key cap is rotated upward on said second engaging portion by said dome portion so that said inner surface of said dome portion is separated from said electric contact;

when a side of a free end of said key cap opposite to said second engaging portion is depressed, said key cap is rotated downward on said second engaaing portion and said dome portion is elastically deformed so that an inner surface of said dome portion presses against said electric contact; and when a side of said second engaging portion of said key cap is depressed, said first engaging portion of said actuator is moved down and then said dome portion is elastically deformed so that an inner surface of said dome portion presses against said electric contact.

22. A keyboard unit of claim 21, further comprising a stopper means for restricting an uppermost position of said first engaging portion of said actuator.

23. A keyboard unit of claim 22, wherein said stopper means comprises:

a rising portion provided on said base plate and having a hole; and a protrusion provided on said actuator and inserted into said hole of said rising portion, said protrusion engaging with said rising portion when said actuator is in the uppermost position.

24. A keyboard unit of claim 22, wherein said stopper means restricts the uppermost position of said first engaging portion by contacting an end portion of said actuator with said base plate.

25. A keyboard unit of claim 22, further comprising an elastic spring portion for urging said actuator upward, said spring portion coming in contact with said actuator when said key cap is depressed.

26. A key switch, comprising:

an electric contact provided on a base plate;

a cover sheet covering said base plate and having an opening;

an elastic dome portion formed on said base plate to as to cover said electric contact, said dome portion protruding through said opening of said cover sheet and over an upper surface of said cover sheet;

a first engaging portion provided on said cover sheet; and a key cap having a second engaging portion which engages with said first engaging portion, and a third engaging portion which engages with said dome portion, said key cap being cantilevered so as to be rotatable on said second engaging portion;

wherein, when said key cap is depressed, said key cap is rotated downward on said second engaging portion and said dome portion is elastically deformed so that an inner surface of said dome portion presses against said electric contact, and when said key cap is not depressed, deformation of said dome portion is removed so that said inner surface of said dome portion is separated from said electric contact, and said key cap is rotated upward on said second engaging portion by said dome portion.

27. The key switch of claim 26, further comprising:

a membrane sheet containing said electric contact and disposed between said base plate and said cover sheet.

28. The key switch of claim 27, further comprising:

an elastic sheet disposed between said membrane sheet and said cover sheet and formed integrally with said dome portion.

29. The key switch of claim 28, wherein:

said cover sheet is formed integrally with said first engaging portion.

30. The key switch of claim 29, wherein said first engaging portion is a bearing portion;

said key switch further comprising a protruding stopper formed on said cover sheet and facing said first engaging portion so that said second engaging portion of said key cap is fitted into a bearing space between said first engaging portion and said protruding stopper.

31. The key switch of claim 26, wherein said dome portion has a top portion having a recess; and said third engaging portion of said key cap is fitted into said recess of said top portion.

32. The key switch of claim 29, further comprising:

a slide member having a first end which is connected to said key cap so that said slide member is rotatable on said first end, and a second end which is slidable on said cover sheet; and a guide member for guiding said second end of said slide member on said cover sheet.

33. The key switch of claim 26, further comprising a fourth engaging portion provided on said cover sheet, said second engaging portion of said key cap being selectively engagable with either said first engaging portion or said fourth engaging portion;

wherein, if said second engaging portion of said key cap is disengaged with said first engaging portion and is engaged with said fourth engaging portion, and the third engaging portion of said key cap is engaged with said dome portion, said key cap is cantilevered so as to be rotatable on said second engaging portion, and wherein when said key cap is depressed, said key cap is rotated downward on said second engaging portion and said dome portion is elastically deformed so that an inner surface of said dome portion presses against said electric contact, and when said key cap is not depressed, deformation of said dome portion is removed so that said inner surface of said dome portion is separated from said electric contact and said key cap is rotated upward on said second engaging portion by said dome portion.

34. The key switch of claim 26, further comprising a fourth engaging portion provided on said cover sheet and disposed opposite to said first engaging portion;

wherein said key cap has a fifth engaging portion disposed opposite to said second engaging portion, said fifth engaging portion of said key cap being adapted to enqaqe with said fourth engaging portion; and wherein, if said fifth engaging portion of said keg cap is encased with said fourth engaging portion, and said second engaging portion is disengaged with said first engaging portion, and the third engaging portion of said key cap is engaged with said dome portion, said key cap is cantilevered so as to be rotatable on said fifth engaging portion, and wherein when said key cap is depressed, said key cap is rotated downward on said fifth engaging portion and said dome portion is elastically deformed so that an inner surface of said dome portion presses against said electric contact, and when said key cap is not depressed, deformation of said dome portion is removed so that said inner surface of said dome portion is separated from said electric contact, and said key cap is rotated upward on said fifth engaging portion by said dome portion.

35. A key switch, comprising:

an electric contact provided on a base plate;

an elastic dome portion formed on said base plate so as to cover said electric contact;

an actuator having a supported portion which is supported on said base plate so that said actuator is able to be swung on said supported portion, and a first engaging portion which is opposite to said supported portion; and a key cap having a second engaging portion which engages with said first engaging portion of said actuator so that said key cap is cantilevered to be rotatable on said second engaging portion of said actuator;

wherein, when said key cap is not depressed, said key cap is rotated upward on said second engaging portion by said dome portion so that said inner surface of said dome portion is separated from said electric contact;

when a side of a free end of said key cap opposite to said second engaging portion is depressed, said key cap is rotated downward on said second engaging portion and said dome portion is elastically deformed so that an inner surface of said dome portion presses against said electric contact; and when a side of said second engaging portion of said key cap is depressed, said first engaging portion of said actuator is moved down and then said dome portion is elastically deformed so that an inner surface of said dome portion presses against said electric contact.

36. A key switch of claim 35, further comprising a stopper means for restricting an uppermost position of said first engaging portion of said actuator.

37. A key switch of claim 36, wherein said stopper means comprises:

a rising portion provided on said base plate and having a hole; and a protrusion provided on said actuator and inserted into said hole of said rising portion, said protrusion engaging with said rising portion when said actuator is in the uppermost position.

38. A key switch of claim 36, wherein said stopper means restricts the uppermost position of said first engaging portion by making contact between an end portion of said actuator with said base plate.

39. A key switch of claim 36, further comprising an elastic spring portion for urging said actuator upward, said spring portion coming in contact with said actuator when said key cap is depressed so that said actuator falls.

* * * * *